US007261650B2

(12) United States Patent
Ohama et al.

(10) Patent No.: US 7,261,650 B2
(45) **Date of Patent: *Aug. 28, 2007**

(54) GOLF BALL

(75) Inventors: Keiji Ohama, Kobe (JP); Takahiro Sajima, Kobe (JP)

(73) Assignee: SRI Sports Limited, Kobe-shi, Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/297,351

(22) Filed: Dec. 9, 2005

(65) Prior Publication Data

US 2006/0154749 A1 Jul. 13, 2006

(30) Foreign Application Priority Data

Jan. 7, 2005 (JP) ..... 2005-002003

(51) Int. Cl.
*A63B 37/14* (2006.01)

(52) U.S. Cl. ..... 473/383

(58) Field of Classification Search ..... 473/383–384
See application file for complete search history.

(56) References Cited

U.S. PATENT DOCUMENTS 5,338,039 A 8/1994 Oka et al.
5,735,757 A 4/1998 Moriyama
5,782,707 A 7/1998 Yamagishi et al.
5,899,822 A 5/1999 Yamagishi et al.
6,599,204 B2 * 7/2003 Kasashima et al. ..... 473/383
6,620,059 B2 9/2003 Sasaki et al.
6,702,695 B1 3/2004 Higuchi et al.
6,899,643 B2 * 5/2005 Sajima et al. ..... 473/383
6,951,520 B2 * 10/2005 Ohama et al. ..... 473/383
2006/0116220 A1 * 6/2006 Ohama et al. ..... 473/371

* cited by examiner

*Primary Examiner*—Raeann Trimiew
(74) *Attorney, Agent, or Firm*—Birch, Stewart, Kolasch & Birch, LLP

(57) ABSTRACT

Golf ball 2 has a core 4, a mid layer 5 and a cover 6. The mid layer 5 has a hardness of 50 or greater and 70 or less, and a thickness of equal to or greater than 0.8 mm. The cover 6 has a hardness of less than 57, and a thickness of less than 1.5 mm. The golf ball 2 has numerous double radius dimples and numerous triple radius dimples on the surface thereof. Proportion of the double radius dimples is 20% or greater and 42% or less, and proportion of the triple radius dimples is equal to or greater than 50%. Ratio (Tm/Tc) of the thickness Tm of the mid layer 5 to the thickness Tc of the cover 6 is 0.5 or greater and 4.0 or less.

7 Claims, 12 Drawing Sheets

GOLF BALL

This application claims priority on patent application Ser. No. 2005-2003 filed in JAPAN on Jan. 7, 2005. The entire contents of this Japanese Patent Application are hereby incorporated by reference.

BACKGROUND OF THE INVENTION

1. Field of the Invention

The present invention relates to golf balls. More particularly, the present invention relates to solid golf balls having a core, a mid layer and a cover.

2. Description of the Related Art

Golf balls have numerous dimples on the surface thereof. In general, golf balls have single radius dimples having a cross-sectional shape with single curvature radius, or double radius dimples having a cross-sectional shape with two curvature radii. The dimples disrupt the air flow around the golf ball during flight to cause turbulent flow separation. By causing the turbulent flow separation, separating points of the air from the golf ball shift backwards leading to the reduction of a drag. The turbulent flow separation promotes the difference between the separating point on the upper side and the separating point on the lower side of the golf ball, which results from the backspin, thereby enhancing the lift force that acts upon the golf ball. Such a role of the dimples is referred to as a "dimple effect". Excellent dimples disturb the air flow more efficiently.

A variety of proposals with respect to the dimples in attempts to improve flight performances have been made. JP-A No. H05-96026 (U.S. Pat. No. 5,338,039) discloses dimples having a shape with the gradient of a slope disposed in the vicinity of the edge being greater than that of a slope at the bottom part. JP-A No. H09-70449 (U.S. Pat. No. 5,735,757) discloses dimples having a cross-sectional shape given by double radius. JP-A No. 2004-166725 (U.S. Pat. No. 6,899,643) discloses dimples having a great ratio of the curvature radius of the bottom part to the curvature radius in the vicinity of the edge.

For golf balls, in addition to flight performances, control performances are also important. Control performances correlate to spin performances. Great back spin rate results in small run (i.e., distance from point of fall of the golf ball to the point where it stopped). For golf players, golf balls which are liable to be spun backwards are apt to be rendered to stop at a targeted position. Great side spin rate results in easily curved trajectory of the golf ball. For golf players, golf balls which are liable to be spun sidewise are apt to allow their trajectory to curve intentionally. High-level golf players particularly place great importance on control performances upon iron shots. Soft covers are responsible for control performances. JP-A No. H09-239068 (U.S. Pat. No. 5,782,707) and JP-A No. H10-151226 (U.S. Pat. No. 5,899,822) disclose a golf ball having a soft cover.

Combinations of a soft cover and unique dimples have been also proposed. JP-A No. 2001-54588 (U.S. Pat. No. 6,702,695) discloses a golf ball having a soft cover, and having dimples improved with respect to their volume. JP-A No. 2002-355342 (U.S. Pat. No. 6,620,059) discloses a golf ball having a soft cover, and having dimples improved with respect to their contour length.

When the golf ball in which a soft cover is used is hit with a driver (W#1), hopping of the golf ball may be caused due to excessive spin. Thus hopped golf ball may not achieve sufficient flight distance.

When golf balls are hit with a short iron, the surface thereof may be scuffed. Particularly, in the case of golf balls having double radius dimples, peripheral edges are liable to be scuffed resulting from concentration of stress. There is still room for improvement of dimples with respect to the scuff resistance.

An object of the present invention is to provide a golf ball that is excellent in the control performance, flight performance and scuff resistance performance.

SUMMARY OF THE INVENTION

Golf ball according to the present invention has a core, a mid layer and a cover. This mid layer has a hardness of 50 or greater and 70 or less, and a thickness of equal to or greater than 0.8 mm. This cover has a hardness less than 57, and a thickness of less than 1.5 mm. This golf ball has numerous double radius dimples and numerous triple radius dimples on the surface thereof. This double radius dimple has a first side wall face having a curvature radius R1, and a bottom face having a curvature radius R2 that is 5 times or more and 55 times or less greater than the curvature radius R1 and being positioned to the bottom side than the first side wall face. This triple radius dimple has a first side wall face having a curvature radius R1 that is equal to or greater than a phantom curvature radius Rx, a second side wall face being positioned to the bottom side than the first side wall face and having a curvature radius R2 that is smaller than the phantom curvature radius Rx, and a bottom face being positioned to the bottom side than the second side wall face and having a curvature radius R3 that is equal to or greater than the phantom curvature radius Rx. Proportion of the number of the double radius dimples in total number of the dimples is 20% or greater and 42% or less. Proportion of the number of the triple radius dimples in total number of the dimples is equal to or greater than 50%.

This golf ball is excellent in control performance because it has a soft cover. In this golf ball, presence of the double radius dimple and the triple radius dimple admixed improves the aerodynamic characteristic of the golf ball. The triple radius dimple is also responsible for the scuff resistance performance. This golf ball is excellent in all terms of control performance, flight performance and scuff resistance performance.

Preferably, in the double radius dimple, the depth of the first side wall face is 0.20 time or more and 0.70 time or less greater than the depth of the dimple. Preferably, in the double radius dimple, the maximum diameter of the bottom face is 0.60 time or more and 0.95 time or less greater than the diameter of the dimple.

Preferably, in the triple radius dimple, the depth of the first side wall face is 0.10 time or more and 0.50 time or less greater than the depth of the dimple. Preferably, in the triple radius dimple, the maximum diameter of the second side wall face is 0.60 time or more and 0.95 time or less greater than the diameter of the dimple.

Preferably, the first sidewall face and the bottom face of the double radius dimple, and the first side wall face, the second side wall face and the bottom face of the triple radius dimple are convex downward.

Preferably, ratio (Tm/Tc) of the thickness Tm of the mid layer to the thickness Tc of the cover is 0.5 or greater and 4.0 or less.

DESCRIPTION OF THE PREFERRED EMBODIMENTS

The present invention is hereinafter described in detail with appropriate references to the accompanying drawing according to the preferred embodiments.

Figure 1:
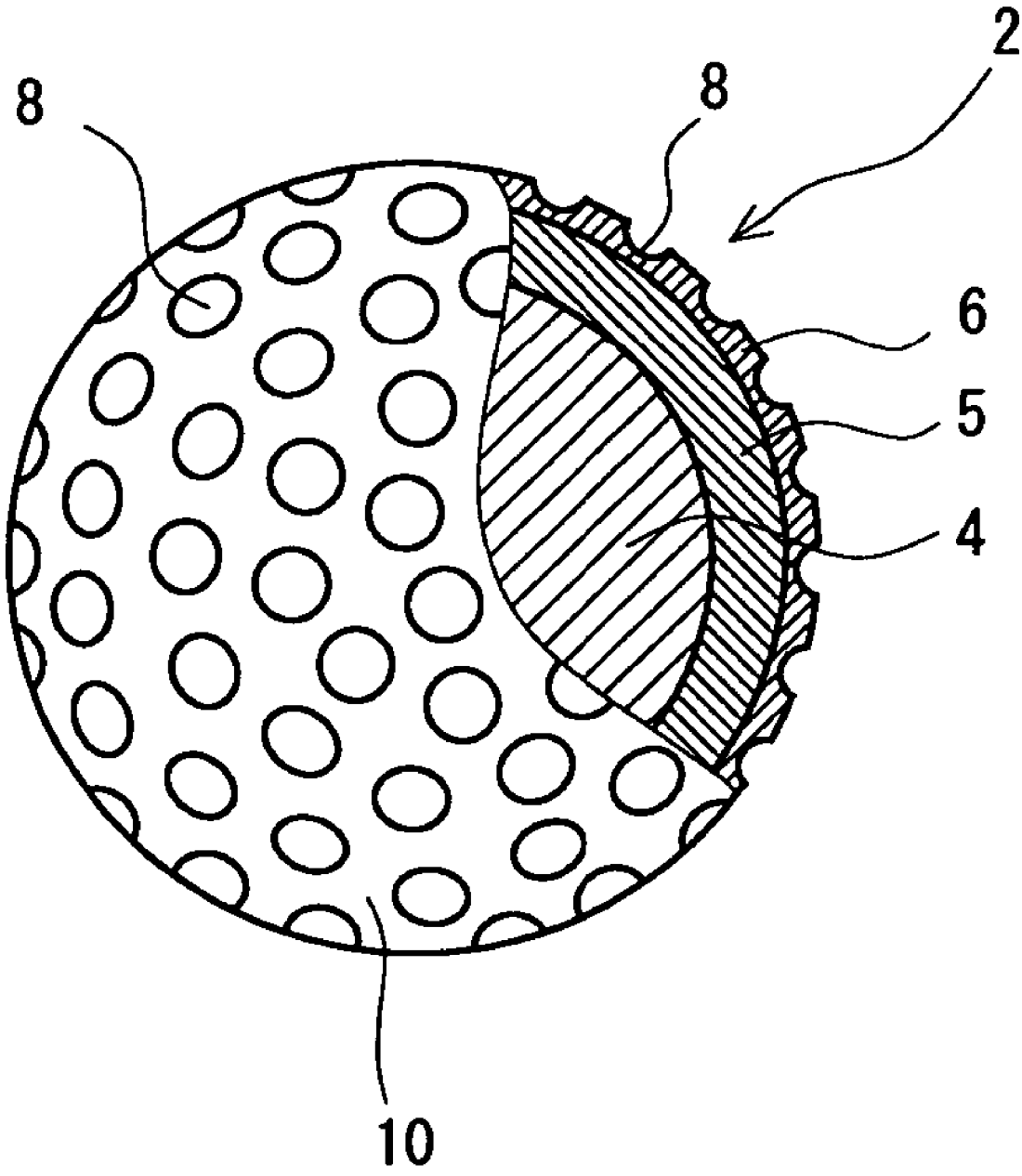
FIG. 1 is a schematic cross-sectional view illustrating a golf ball according to one embodiment of the present invention.

A golf ball 2 illustrated in FIG. 1 has a spherical core 4, a mid layer 5 covering this core 4, and a cover 6 covering this mid layer 5. Numerous dimples 8 are formed on the surface of the cover 6. Of the surface of the golf ball 2, a part except for the dimples 8 is a land 10. This golf ball 2 has a paint layer and a mark layer to the external side of the cover 6, although these layers are not shown in the Figure. The golf ball 2 may have other layer between the core 4 and the mid layer 5. The golf ball 2 may have other layer between the mid layer 5 and the cover 6.

The cover 6 herein means an outermost layer except for the paint layer and mark layer. Although there exist golf balls referred to as having a cover with a two layered structure, in this instance, the outer layer corresponds to the cover 6 herein.

This golf ball 2 has a diameter of from 40 mm to 45 mm. From the standpoint of conformity to a rule defined by United States Golf Association (USGA), the diameter is preferably equal to or greater than 42.67 mm. In light of suppression of the air resistance, the diameter is preferably equal to or less than 44 mm, and more preferably equal to or less than 42.80 mm. Weight of this golf ball 2 is 40 g or greater and 50 g or less. In light of attainment of great inertia, the weight is preferably equal to or greater than 44 g, and particularly preferably equal to or greater than 45.00 g. From the standpoint of conformity to a rule defined by USGA, the weight is preferably equal to or less than 45.93 g.

The core 4 is obtained through crosslinking of a rubber composition. Illustrative examples of the base rubber for use in the core 4 include polybutadienes, polyisoprenes, styrene-butadiene copolymers, ethylene-propylene-diene copolymers and natural rubbers. Two or more kinds of the rubbers may be used in combination. In light of the resilience performance, polybutadienes are preferred. When other rubber is used in combination with a polybutadiene, it is preferred that polybutadiene is included as a principal component. Specifically, percentage of polybutadiene in the entire base rubber is preferably equal to or greater than 50% by weight, and more preferably equal to or greater than 80% by weight. High cis-polybutadienes having a percentage of cis-1,4 bonds of equal to or greater than 80% are particularly preferred.

For crosslinking of the core 4, a co-crosslinking agent is used. Preferable examples of the co-crosslinking agent in light of the resilience performance include monovalent or bivalent metal salts of an α,β-unsaturated carboxylic acid having 2 to 8 carbon atoms. Specific examples of preferable co-crosslinking agent include zinc acrylate, magnesium acrylate, zinc methacrylate and magnesium methacrylate. Zinc acrylate and zinc methacrylate are particularly preferred on the grounds that a high resilience performance can be achieved.

As a co-crosslinking agent, an α,β-unsaturated carboxylic acid having 2 to 8 carbon atoms, and a metal oxide may be also blended. Both components react in the rubber composition to give a salt. This salt serves as a co-crosslinking agent. Examples of preferable α,β-unsaturated carboxylic acid include acrylic acid and methacrylic acid, and acrylic acid is particularly preferred. Examples of preferable metal oxide include zinc oxide and magnesium oxide, and zinc oxide is particularly preferred.

In light of the resilience performance of the golf ball 2, the amount of the co-crosslinking agent to be blended is preferably equal to or greater than 10 parts by weight, and more preferably equal to or greater than 15 parts by weight per 100 parts by weight of the base rubber. In light of soft feel at impact, the amount of the co-crosslinking agent to be blended is preferably equal to or less than 50 parts by weight, and more preferably equal to or less than 45 parts by weight per 100 parts by weight of the base rubber.

Into the core 4, an organic peroxide may be preferably blended together with the co-crosslinking agent. The organic peroxide is responsible for a crosslinking reaction. By blending the organic peroxide, the resilience performance of the golf ball 2 may be improved. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. Particularly versatile organic peroxide is dicumyl peroxide.

In light of the resilience performance of the golf ball 2, the amount of the organic peroxide to be blended is preferably equal to or greater than 0.1 part by weight, more preferably equal to or greater than 0.3 part by weight, and particularly preferably equal to or greater than 0.5 part by weight per 100 parts by weight of the base rubber. In light of soft feel at impact, the amount of the organic peroxide to be blended is preferably equal to or less than 3.0 parts by weight, more preferably equal to or less than 2.8 parts by weight, and particularly preferably equal to or less than 2.5 parts by weight per 100 parts by weight of the base rubber.

It is preferred that an organic sulfur compound (including a salt) be blended in the core 4. The organic sulfur compound is responsible for the resilience performance of the golf ball 2. Illustrative examples of preferable organic sulfur compound include diphenyl disulfide and bis(pentabromophenyl)disulfide.

In light of the resilience performance of the golf ball 2, the amount of the organic sulfur compound to be blended is preferably equal to or greater than 0.1 part by weight, more preferably equal to or greater than 0.2 part by weight, and particularly preferably equal to or greater than 0.3 part by weight per 100 parts by weight of the base rubber. In light of soft feel at impact, the amount of the organic sulfur compound to be blended is preferably equal to or less than 5.0 parts by weight, more preferably equal to or less than 3.0 parts by weight, and particularly preferably equal to or less than 2.0 parts by weight per 100 parts by weight of the base rubber.

Into the core 4 may be blended a filler for the purpose of adjusting specific gravity and the like. Illustrative examples of suitable filler include zinc oxide, barium sulfate, calcium carbonate and magnesium carbonate. Powder of a highly dense metal may be blended as a filler. Specific examples of the highly dense metal include tungsten and molybdenum. The amount of the filler to be blended is determined ad libitum so that the intended specific gravity of the core 4 can be accomplished. Particularly preferable filler is zinc oxide. Zinc oxide also serves as a crosslinking activator. Various kinds of additives such as an anti-aging agent, a coloring agent, a plasticizer, a dispersant and the like may be blended at an adequate amount to the core 4 as needed. Into the core 4 may be also blended crosslinked rubber powder or synthetic resin powder.

In light of the feel at impact of the golf ball 2, amount of compressive deformation of the core 4 is preferably equal to or greater than 1.5 mm, and particularly preferably equal to or greater than 2.0 mm. In light of the resilience performance of the golf ball 2, amount of compressive deformation of the core 4 is preferably equal to or less than 5.0 mm, more preferably equal to or less than 4.5 mm, and particularly preferably equal to or less than 4.0 mm. Upon measurement of the amount of compressive deformation, the core 4 is first placed on a hard plate made of metal. Next, a cylinder made of metal gradually descends toward the core 4. The core 4 intervened between the bottom face of the cylinder and the hard plate is deformed. A migration distance of the cylinder, starting from the state in which initial load of 98 N is applied to the core 4 up to the state in which final load of 1274 N is applied thereto is the amount of compressive deformation.

In light of the resilience performance of the golf ball 2, the core 4 has a surface hardness of preferably equal to or greater than 50, and more preferably equal to or greater than 55. In light of the feel at impact and suppression of spin of the golf ball 2, the core 4 has a surface hardness of preferably equal to or less than 75, and more preferably equal to or less than 70. For the measurement of the surface hardness, an automated rubber hardness machine which is equipped with a Shore D type spring hardness scale (trade name "P1", available from Koubunshi Keiki Co., Ltd.) is used. This hardness scale is pressed against the surface of the core.

The core 4 has a diameter of preferably 36.0 mm or greater and 41.0 mm or less. The core 4 has a weight of preferably 25 g or greater and 42 g or less. Crosslinking temperature of the core 4 is usually 140° C. or greater and 180° C. or less. The crosslinking time period of the core 4 is usually 10 minutes or longer and 60 minutes or less. The core 4 may be formed with two or more layers. Other layer comprising a resin composition or a rubber composition may be provided between the core and the mid layer.

The mid layer 5 comprises a thermoplastic resin composition. Base polymer of this resin composition is an ionomer resin. Ionomer resins are highly elastic. As described later, this golf ball 2 has a thin cover 6. Upon hitting of this golf ball 2 with a driver, the mid layer 5 is deformed greatly in conjunction with the cover 6. The mid layer in which an ionomer resin is used is responsible for the flight performance upon shots with a driver.

Preferably, an ionomer resin may be used that is a copolymer of α-olefin and an α,β-unsaturated carboxylic acid having 3 to 8 carbon atoms in which a part of the carboxylic acid is neutralized with a metal ion. Examples of preferable α-olefin include ethylene and propylene. Examples of preferable α,β-unsaturated carboxylic acid include acrylic acid and methacrylic acid. Illustrative examples of the metal ion for use in the neutralization include sodium ion, potassium ion, lithium ion, zinc ion, calcium ion, magnesium ion, aluminum ion and neodymium ion. The neutralization may also be carried out with two or more kinds of the metal ions. In light of the resilience performance and durability of the golf ball 2, particularly suitable metal ions are sodium ion, zinc ion, lithium ion and magnesium ion.

Ethylene-(meth)acrylic acid copolymer based ionomer resins are particularly preferred. The ethylene-(meth)acrylic acid copolymer based ionomer resin may be obtained by the copolymerization of ethylene and acrylic acid or methacrylic acid. This ionomer resin generally contains 70% by weight or greater and 95% by weight or less of an ethylene component, and 5% by weight or greater and 30% by weight or less of an acrylate component or a methacrylate component.

Specific examples of the ionomer resin include trade names "Himilan 1555", "Himilan 1557", "Himilan 1605", "Himilan 1706", "Himilan 1707", "Himilan AM7311", "Himilan AM7315", "Himilan AM7317", "Himilan AM7318" and "Himilan MK7320", available from Du Pont-MITSUI POLYCHEMICALS Co., Ltd.; trade names "Surlyn® 7930", "Surlyn® 7940", "Surlyn® 8140", "Surlyn® 8940", "Surlyn® 8945", "Surlyn® 9120", "Surlyn® 9910" and "Surlyn® 9945", available from Dupont; and trade names "IOTEK 7010", "IOTEK 7030", "IOTEK 8000" and "IOTEK 8030", available from EXXON Corporation.

Other resin may be used as the base polymer in place of the ionomer resin or together with the ionomer resin. Illustrative examples of the other resin include styrene block-containing thermoplastic elastomers, thermoplastic polyurethane elastomers, thermoplastic polyamide elastomers, thermoplastic polyester elastomers and thermoplastic polyolefin elastomers. When the ionomer resin and the other resin are used in combination, the ionomer resin is included as a principal component of the base polymer in light of the flight performance. Proportion of the ionomer resin to the total base polymer is preferably equal to or greater than 60% by weight, and more preferably equal to or greater than 70% by weight.

Specific examples of the styrene block-containing thermoplastic elastomer include "Epofriend® A1010", a trade name by Daicel Chemical Industries; "Septon HG-252", a trade name by Kuraray Co., Ltd.; and "Rabalon® T3339C", "Rabalon® SJ5400N", "Rabalon® SJ6400N", "Rabalon® SJ7400N", "Rabalon® SJ8400N", "Rabalon®SJ9400N" and "Rabalon® SR04", trade names by Mitsubishi Chemical Corporation. Specific examples of the thermoplastic polyurethane elastomer include "Kuramilon 9180" and "Kuramilon 9195", trade names by Kuraray Co., Ltd.; and "Elastollan XNY90A", "Elastollan XNY97A", "Elastollan XNY585" and "Elastollan XNY85A", trade names by BASF Polyurethane Elastomers Co., Ltd. Specific examples of the thermoplastic polyamide elastomer include "Pebax 2533", a trade name by Toray Industries, Inc. Specific examples of the thermoplastic polyester elastomer include "Hytrel® 4047", "Hytrel® 4767" and "Hytrel® 5557", trade names by Du Pont-TORAY Co., LTD.; and "Primalloy® A1500", a trade name by Mitsubishi Chemical Corporation. Specific examples of the thermoplastic polyolefin elastomer include "Milastomer® M4800NW", a trade name by Mitsui Chemicals, Inc.; and "TPE 3682" and "TPE 9455", trade names by Sumitomo Chemical Co., Ltd.

Into the resin composition of the mid layer 5 may be blended a filler for the purpose of adjusting specific gravity and the like. Illustrative examples of suitable filler include zinc oxide, barium sulfate, calcium carbonate and magnesium carbonate. Powder of a highly dense metal may be also blended as a filler. Specific examples of the highly dense metal include tungsten and molybdenum. The amount of the filler to be blended is determined ad libitum so that intended specific gravity of the mid layer 5 can be accomplished. Into the mid layer 5 may be also blended a coloring agent, crosslinked rubber powder or synthetic resin powder.

In light of the resilience performance of the golf ball 2, the mid layer 5 has a hardness Hm of preferably equal to or greater than 50, and more preferably equal to or greater than 55. In light of the feel at impact of the golf ball 2, the hardness Hm is preferably equal to or less than 70, and more preferably equal to or less than 65.

In the present invention, the hardness Hm of the mid layer 5 and the hardness Hc of the cover 6 may be measured in accordance with a standard of "ASTM-D 2240-68". For the measurement, an automated rubber hardness machine which is equipped with a Shore D type spring hardness scale (trade name "P1", available from Koubunshi Keiki Co., Ltd.) is used. For the measurement, a sheet which was formed by hot press is used having a thickness of about 2 mm and consisting of the same material as the mid layer 5 (or the cover 6). Prior to the measurement, the sheet is stored at a temperature of 23° C. for two weeks. When the measurement is carried out, three sheets are overlaid.

In light of the resilience performance and durability performance of the golf ball 2, the mid layer 5 has a thickness Tm of preferably equal to or greater than 0.8 mm, and more preferably equal to or greater than 1.0 mm. In light of the feel at impact of the golf ball 2, the thickness Tm is preferably equal to or less than 2.0 mm, and more preferably equal to or less than 1.8 mm.

This golf ball 2 has a soft cover 6. Specifically, the cover 6 has a hardness Hc of less than 57. The soft cover 6 elevates the spin rate. The golf ball 2 having a soft cover 6 is excellent in the control performance upon iron shots, in particular. In light of the control performance, the hardness Hc is more preferably equal to or less than 56, and particularly preferably equal to or less than 52. In light of the resilience performance and durability performance of the golf ball 2, the hardness Hc is preferably equal to or greater than 40, and more preferably equal to or greater than 45.

The soft cover 6 can be obtained by using a soft polymer. Examples of suitable polymer include thermoplastic polyurethane elastomers. The thermoplastic polyurethane elastomer includes a polyurethane component as a hard segment, and a polyester component or a polyether component as a soft segment. Illustrative examples of curing agent for the polyurethane component include alicyclic diisocyanate, aromatic diisocyanate and aliphatic diisocyanate. In particular, alicyclic diisocyanate is preferred. Because the alicyclic diisocyanate has no double bond in the main chain, yellowing of the cover 6 can be suppressed. Additionally, because the alicyclic diisocyanate is excellent in strength, the cover 6 can be prevented from being scuffed. Two or more kinds of the diisocyanate may be used in combination. Illustrative examples of the alicyclic diisocyanate include 4,4'-dicyclohexylmethane diisocyanate ($H_{12}MDI$) that is a hydrogenated product of 4,4'-diphenylmethane diisocyanate, 1,3-bis(isocyanatomethyl)cyclohexane ($H_6XDI$) that is a hydrogenated product of xylylene diisocyanate, isophorone diisocyanate (IPDI) and trans-1,4-cyclohexane diisocyanate (CHDI). In light of versatility and processability, $H_{12}MDI$ is preferred. Illustrative examples of the aromatic diisocyanate include 4,4'-diphenylmethane diisocyanate (MDI) and toluene diisocyanate (TDI). Illustrative examples of the aliphatic diisocyanate include hexamethylene diisocyanate (HDI). Specific examples of the thermoplastic polyurethane elastomer include the aforementioned trade names "Elastollan XNY90A", "Elastollan XNY97A", "Elastollan XNY585" and "Elastollan XNY85A".

Other resin may be used as the base polymer in place of the thermoplastic polyurethane elastomer or together with the thermoplastic polyurethane elastomer. Illustrative examples of the other resin include styrene block-containing thermoplastic elastomers, thermoplastic polyamide elastomers, thermoplastic polyester elastomers, thermoplastic polyolefin elastomers and ionomer resins. When the thermoplastic polyurethane elastomer and the other resin are used in combination, the thermoplastic polyurethane elastomer is included as a principal component of the base polymer in light of the control performance. Proportion of the thermoplastic polyurethane elastomer to the total base polymer is preferably equal to or greater than 60% by weight, and more preferably equal to or greater than 70% by weight.

Into the cover 6 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. Powder of a highly dense metal such as tungsten and molybdenum may be also blended for the purpose of adjusting the specific gravity. The cover 6 has a specific gravity of 0.90 or greater and 1.15 or less.

In light of the control performance and durability performance of the golf ball 2, the cover 6 has a thickness Tc of preferably equal to or greater than 0.3 mm, and more preferably equal to or greater than 0.6 mm. In light of the resilience performance of the golf ball 2, the cover 6 has a thickness Tc of preferably less than 1.5 mm, and more preferably less than 1.0 mm.

In light of the resilience performance of the golf ball 2, ratio (Tm/Tc) of the thickness Tc of the cover 6 to the thickness Tm of the mid layer 5 is preferably equal to or greater than 0.5, more preferably equal to or greater than 1.0, and particularly preferably equal to or greater than 1.5. In light of the control performance and feel at impact of the golf ball 2, the ratio (Tm/Tc) is preferably equal to or less than 4.0, and more preferably equal to or less than 3.5.

Figure 2:
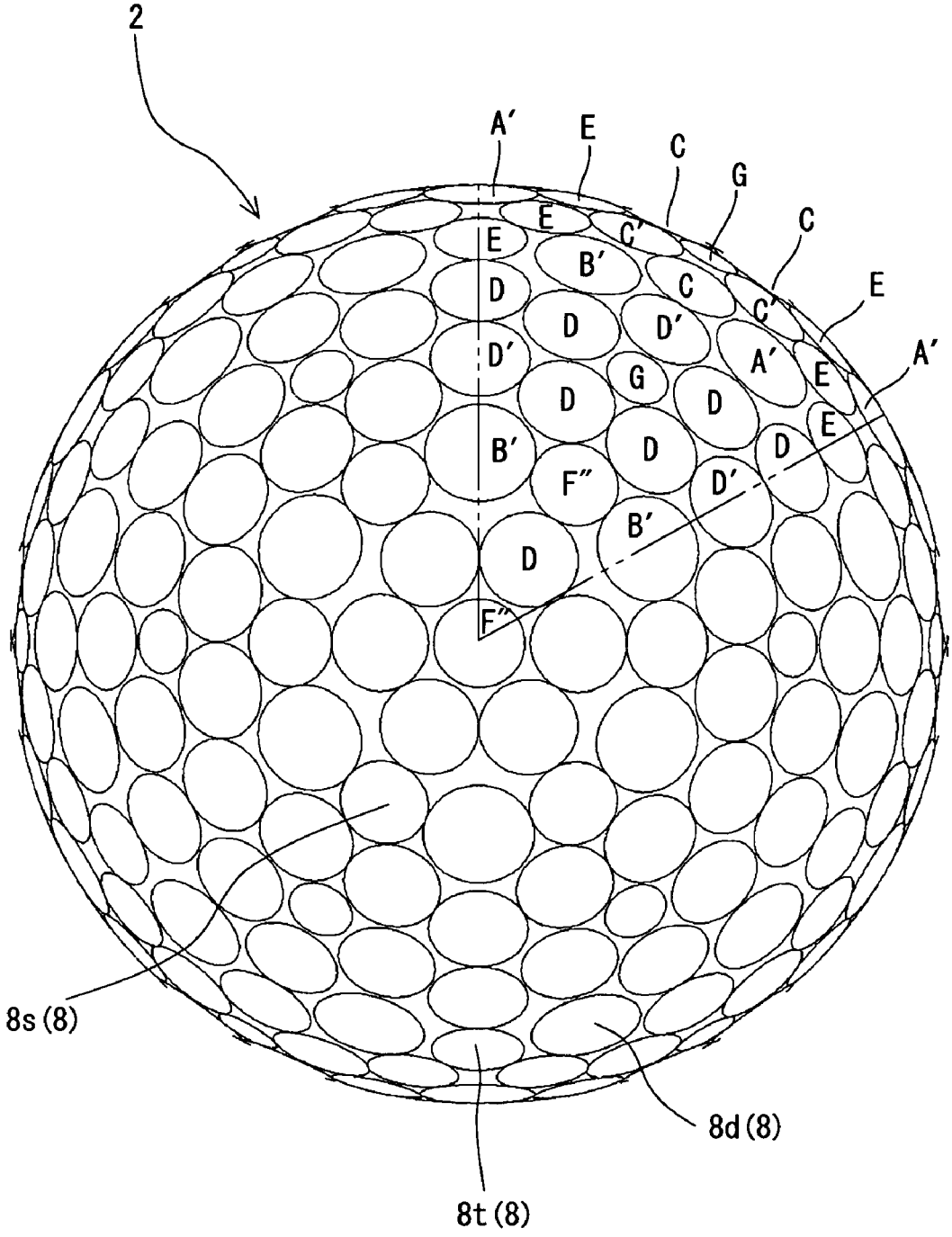
FIG. 2 is an enlarged plan view illustrating the golf ball shown in FIG. 1.
Figure 3:
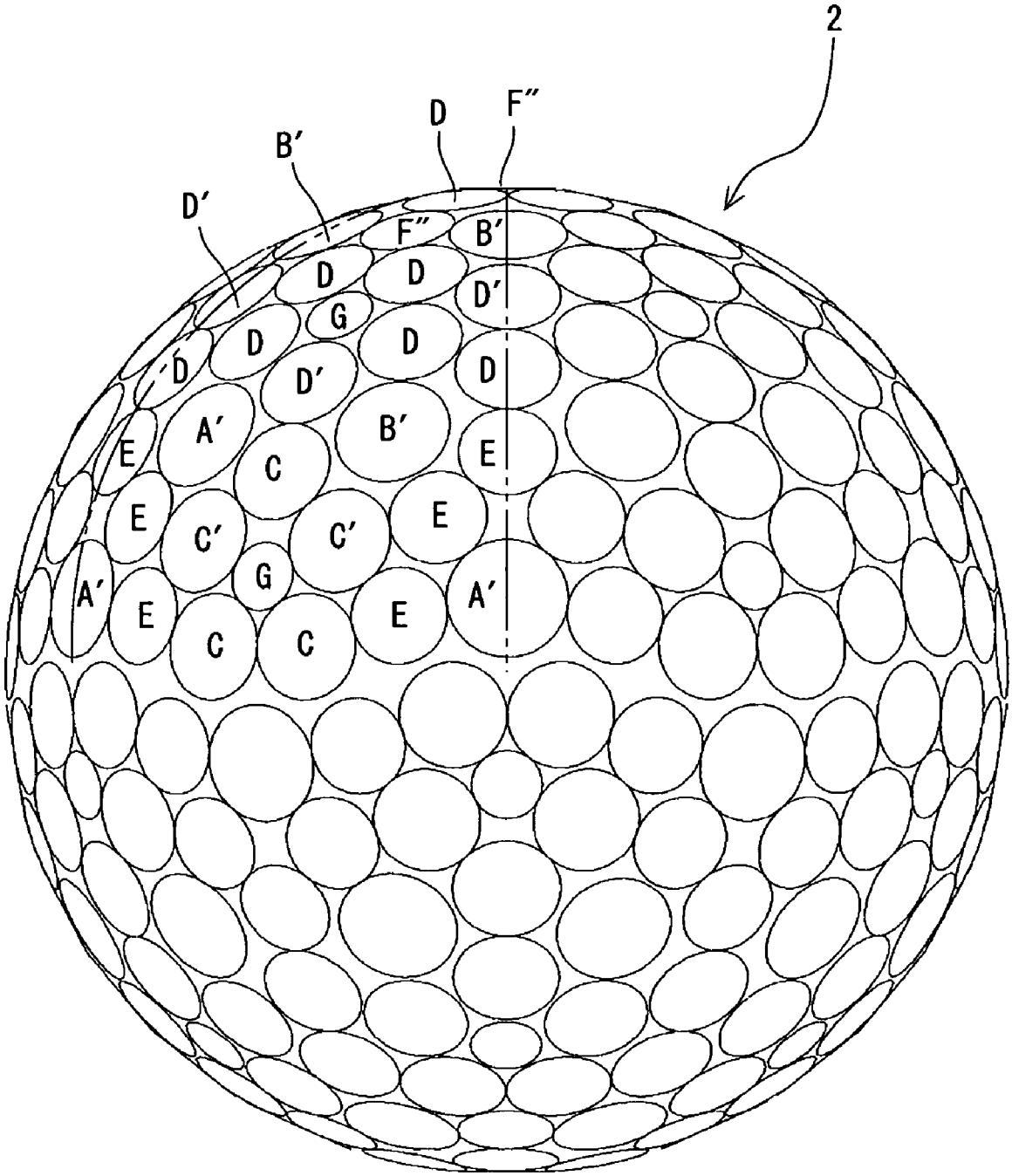
FIG. 3 is a front view illustrating the golf ball shown in FIG. 2.

FIG. 2 is an enlarged plan view illustrating the golf ball 2 shown in FIG. 1; and FIG. 3 is a front view of the same. As is clear from FIG. 2 and FIG. 3, the plane shape of all the dimples 8 is circular. In FIG. 2 and FIG. 3, kinds of the dimples 8 are denoted by symbols in one unit, provided when the surface of the golf ball 2 is comparted into twelve equivalent units. This golf ball 2 has dimples A' having a diameter of 5.10 mm, dimples B' having a diameter of 5.00 mm, dimples C having a diameter of 4.60 mm, dimples C' having a diameter of 4.60 mm, dimples D having a diameter of 4.50 mm, dimples D' having a diameter of 4.50 mm, dimples E having a diameter of 4.20 mm, dimples F" having a diameter of 4.00 mm, and dimples G having a diameter of 3.00 mm. The number of the dimples A' is 24; the number of the dimples B' is 24; the number of the dimples C is 36; the number of the dimples C' is 24; the number of the dimples D is 72; the number of the dimples D' is 24; the number of the dimples E is 60; the number of the dimples F" is 14; and the number of the dimples G is 24. Total number of the dimples 8 of this golf ball 2 is 302.

The dimples A', B', C' and D' are double radius dimples 8*d*. The dimples C, D, E and G are triple radius dimples 8*t*. The dimple F" is a single radius dimple 8*s*.

Figure 4:
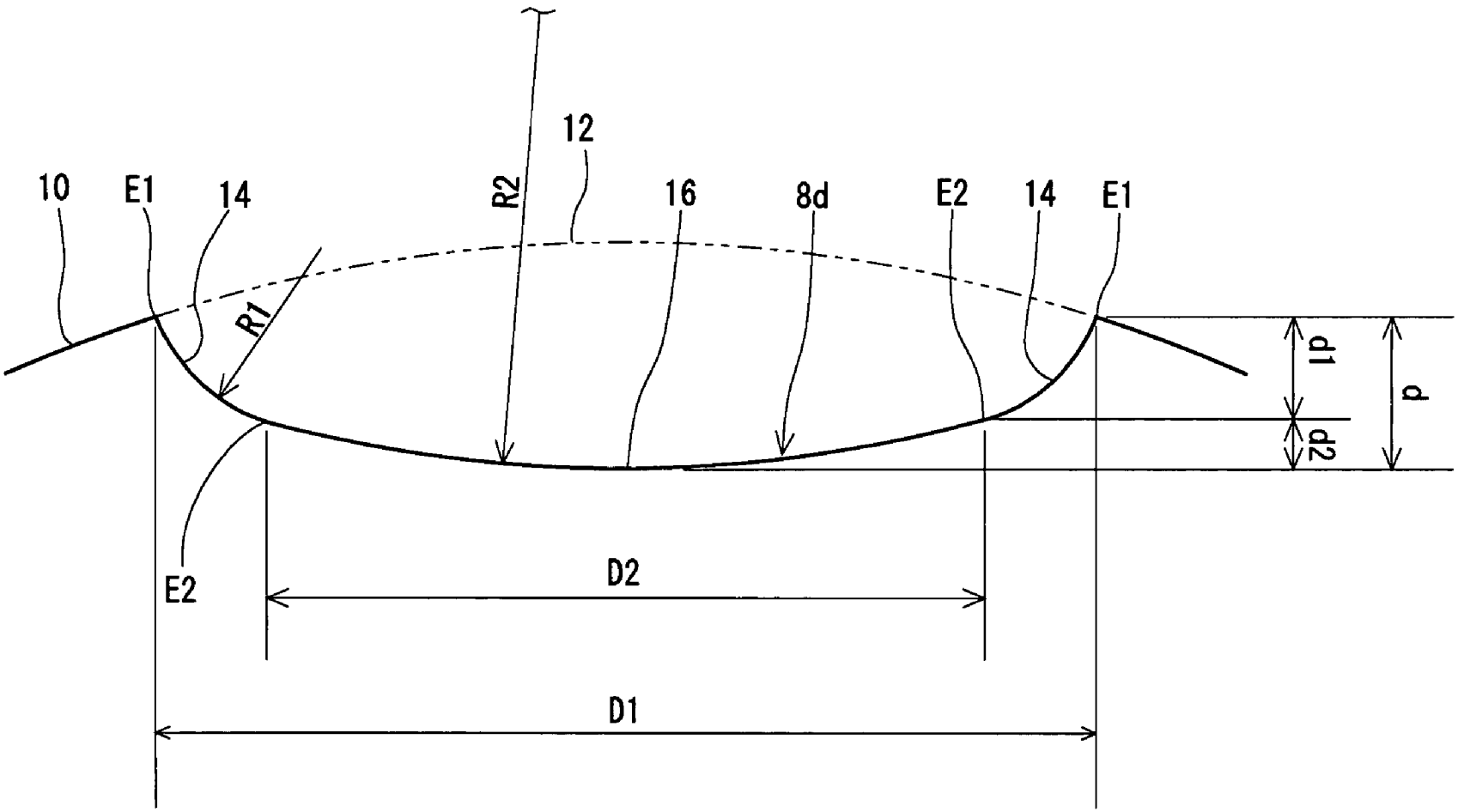
FIG. 4 is an enlarged cross-sectional view illustrating a part of the golf ball shown in FIG. 1.

FIG. 4 is an enlarged cross-sectional view illustrating a part of the golf ball 2 shown in FIG. 1. In this FIG. 4, a double radius dimple 8*d* is illustrated. In this FIG. 4, a cross section along a plane passing through the weighted center of area of the dimple 8*d* and the center of the golf ball 2 is shown. A top-to-bottom direction in FIG. 4 is an in-depth direction of the dimple 8*d*. The in-depth direction is a direction from the weighted center of area of the dimple 8*d* toward the center of the golf ball 2. What is indicated by a chain double-dashed line 12 in FIG. 4 is a phantom sphere. The surface of the phantom sphere 12 corresponds to a surface of the golf ball 2 when it is postulated that there is no dimple 8*d* present. The dimple 8*d* is recessed from the phantom sphere 12. The land 10 agrees with the phantom sphere 12.

This dimple 8*d* has a first side wall face 14 and a bottom face 16. The first side wall face 14 is ring shaped. The bottom face 16 is bowl shaped. The first side wall face 14 is continued to the land 10 at a point E1. The point E1 corresponds to the edge of the dimple 8*d*. The edge E1 defines plane shape of the dimple 8*d*. The edge E1 may be rounded. The bottom face 16 is positioned on the bottom side of the first side wall face 14. The bottom face 16 is continued to the first side wall face 14 at the point E2. The bottom face 16 is in contact with the first side wall face 14.

What is indicated by a both-oriented arrowhead D1 in FIG. 4 is the diameter of the dimple 8*d*, and what is indicated by a both-oriented arrowhead D2 is a maximum diameter of the bottom face 16. This diameter D1 is also a maximum diameter of the first side wall face 14. The diameter D1 of the dimple 8*d* is preferably 2.0 mm or greater and 6.0 mm or less. When the diameter D1 is less than the above range, dimple effect may be hardly exerted. In this respect, the diameter D1 is more preferably equal to or greater than 2.2 mm, and particularly preferably equal to or greater than 2.4 mm. When the diameter D1 is beyond the above range, a feature of the golf ball 2 which is substantially a sphere may be impaired. In this respect, the diameter D1 is more preferably equal to or less than 5.8 mm, and particularly preferably equal to or less than 5.6 mm.

The first sidewall face 14 is convex downward. Maximum diameter line of the first side wall face 14 passes through the point E1. In other words, the first side wall face 14 does not run off the point E1 outside in the horizontal direction. Accordingly, accumulation of the air is prevented. The undermost point of the first side wall face 14 agrees with the point E2. In other words, the first side wall face 14 inclines downward from the point E1 to the point E2. Accordingly, accumulation of the air is prevented.

The bottom face 16 is convex downward. Maximum diameter line of the bottom face 16 passes through the point E2. In other words, the bottom face 16 does not run off the point E2 outside in the horizontal direction. Accordingly, accumulation of the air is prevented.

What is indicated by an arrowhead R1 in FIG. 4 is the curvature radius of the first side wall face 14, and what is indicated by an arrowhead R2 is the curvature radius of the bottom face 16. The curvature radius R2 is greater than the curvature radius R1. In other words, the first side wall face 14 is a steep slope, while the bottom face 16 is a gentle slope. In this dimple 8*d*, the ratio (R2/R1) is equal to or greater than 5. This ratio (R2/R1) is greater than the ratio (R2/R1) of conventional double radius dimples. This dimple 8*d* is responsible for the flight performance of the golf ball 2. Although grounds for contribution of this dimple 8*d* to the flight performance of the golf ball 2 are uncertain in detail, it is speculated that air flow that passes over the first side wall face 14 is disrupted due to great ratio (R2/R1), thereby the drag being reduced. In light of the flight performance, the ratio (R2/R1) is more preferably equal to or greater than 10, and particularly preferably equal to or greater than 15. When the ratio (R2/R1) is too great, the air flow on the bottom face 16 becomes monotonous, therefore, the ratio (R2/R1) is preferably equal to or less than 55, more preferably equal to or less than 52, and particularly preferably equal to or less than 50. The curvature radius R1 is preferably 0.3 mm or greater and 10.0 mm or less. The curvature radius R2 is preferably 2.0 mm or greater and 60.0 mm or less.

Maximum diameter D2 of the bottom face 16 is preferably 0.60 time or more and 0.95 time or less greater than the diameter D1 of the dimple 8*d*. When the diameter D2 is less than the above range, contributing rate of the bottom face 16 to the dimple effect may become insufficient. In this respect, the diameter D2 is more preferably equal to or more than 0.70 time, and particularly preferably equal to or more than 0.75 time greater than the diameter D1. When the diameter D2 is beyond the above range, contributing rate of first side wall face 14 to the dimple effect may become insufficient. In this respect, the diameter D2 is more preferably equal to or less than 0.93 time, and particularly preferably equal to or less than 0.90 time greater than the diameter D1.

What is indicated by a both-oriented arrowhead d1 in FIG. 4 is the depth of the first side wall face 14; and what is indicated by a both-oriented arrowhead d2 is the depth of the bottom face 16. Sum total of the depth d1 and the depth d2 is the depth d of the dimple 8*d*.

The depth d1 of the first side wall face 14 is preferably 0.20 time or more and 0.70 time or less greater than the depth d of the dimple 8*d*. When the depth d1 is less than the above range, contributing rate of the first side wall face 14 to the dimple effect may become insufficient. In this respect, the depth d1 is more preferably equal to or more than 0.22 time, and particularly preferably equal to or more than 0.25 time greater than the depth d. When the depth d1 is beyond the above range, contributing rate of the bottom face 16 to the dimple effect may become insufficient. In this respect, the depth d1 is more preferably equal to or less than 0.68 time, and particularly preferably equal to or less than 0.65 time greater than the depth d.

Figure 5:
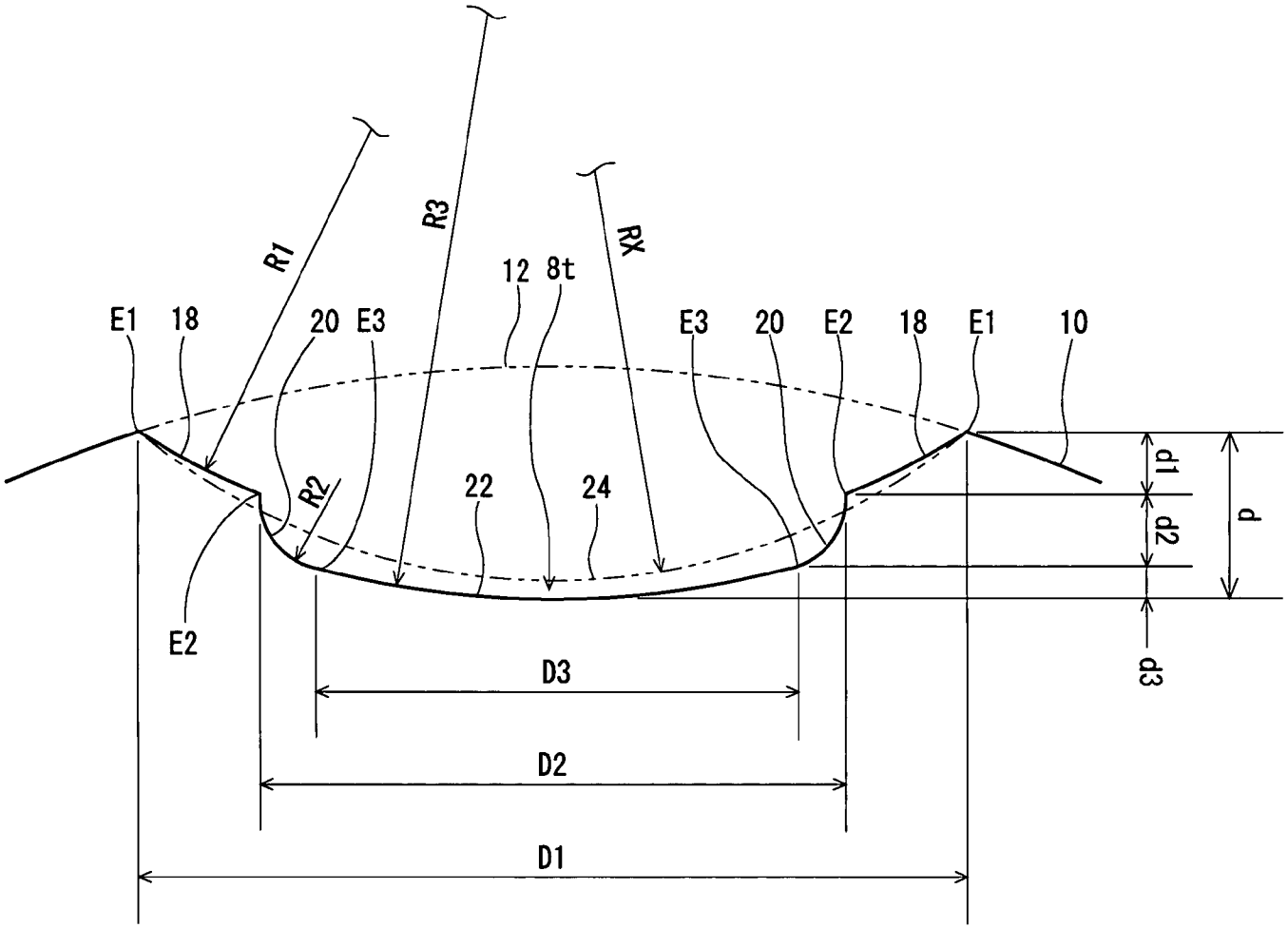
FIG. 5 is an enlarged cross-sectional view illustrating a part of the golf ball shown in FIG. 1.

FIG. 5 is an enlarged cross-sectional view illustrating a part of the golf ball 2 shown in FIG. 1. In this FIG. 5, a triple radius dimple 8*t* is illustrated. This dimple 8*t* has a first side wall face 18, a second side wall face 20 and a bottom face 22. The first side wall face 18 and second side wall face 20 are ring shaped. The bottom face 22 is bowl shaped. The first side wall face 18 is continued to the land 10 at an edge E1. The edge E1 may be rounded. The second side wall face 20 is positioned on the bottom side of the first side wall face 18. The second side wall face 20 is continued to the first side wall face 18 at the point E2. The edge E2 may be rounded. The bottom face 22 is positioned on the bottom side of the second side wall face 20. The bottom face 22 is continued to the second side wall face 20 at the point E3. The bottom face 22 is in contact with the second side wall face 20.

What is indicated by a both-oriented arrowhead D1 in FIG. 5 is the diameter of the dimple 8*t*; what is indicated by the both-oriented arrowhead D2 is the maximum diameter of the second side wall face 20; and what is indicated by the both-oriented arrowhead D3 is the maximum diameter of the bottom face 22. This diameter D1 is also the maximum diameter of the first side wall face 18. The diameter D1 of the dimple 8*t* is preferably 2.0 mm or greater and 6.0 mm or less. When the diameter D1 is less than the above range, dimple effect may be hardly exerted. In this respect, the diameter D1 is more preferably equal to or greater than 2.2 mm, and particularly preferably equal to or greater than 2.4 mm. When the diameter D1 is beyond the above range, a feature of the golf ball 2 which is substantially a sphere may be impaired. In this respect, the diameter D1 is more preferably equal to or less than 5.8 mm, and particularly preferably equal to or less than 5.6 mm.

In FIG. 5, what is indicated by a chain double-dashed line 24 is a phantom dimple. The phantom dimple 24 has a cross-sectional shape of a circular arc. Curvature radius of this circular arc is denoted by a symbol Rx in FIG. 5. This phantom dimple 24 is a single radius dimple. The phantom dimple 24 has a diameter of D1. In other words, the phantom dimple 24 has a diameter that is equal to the diameter of the triple radius dimple 8*t*. The phantom dimple 24 is envisioned to have a volume that is equal to the volume of the triple radius dimple 8*t*. The phantom curvature radius Rx is usually 5.0 mm or greater and 25.0 mm or less.

The first side wall face 18 is convex downward. The first side wall face 18 has a curvature radius R1 that is equal to or greater than the phantom curvature radius Rx. In other words, the first side wall face 18 curves gently. The air passed through the land 10 flows along the first side wall face 18. The air flows smoothly from the land 10 toward the center of the dimple 8*t* because the first side wall face 18 has a gentle curve. The first side wall face 18 having a gentle curve moderates the concentration of stress in the vicinity of the edge E1. This triple radius dimple 8*t* prevents the golf ball 2 from scuffing of the cover 6 upon a hit with a short iron. The triple radius dimple 8*t* is responsible for scuff resistance performance of the golf ball 2. In light of the smooth air flow and scuff resistance performance, the curvature radius R1 is preferably equal to or greater than 7.0 mm, and particularly preferably equal to or greater than 8.0 mm. The curvature radius R1 is preferably equal to or less than 30.0 mm.

Maximum diameter line of the first side wall face 18 passes through the point E1. In other words, the first side wall face 18 does not run off the point E1 outside in the horizontal direction. Accordingly, accumulation of the air is prevented. The undermost point of the first side wall face 18 agrees with the point E2. In other words, the first side wall face 18 inclines downward from the point E1 to the point E2. Accordingly, accumulation of the air is prevented.

The second side wall face 20 is convex downward. The second side wall face 20 has a curvature radius R2 that is less than the phantom curvature radius Rx. The air passed through the first side wall face 18 flows along the second side wall face 20. Direction of the air is suddenly changed by the second side wall face 20. This change in direction enhances the dimple effect. In light of the dimple effect, the curvature radius R2 is preferably equal to or less than 0.40 time, more preferably equal to or less than 0.30 time, and particularly preferably equal to or less than 0.25 time greater than the phantom curvature radius Rx. The curvature radius R2 is preferably equal to or more than 0.10 time greater than the phantom curvature radius Rx. The curvature radius R2 is preferably 1.5 mm or greater and 5.0 mm or less.

Maximum diameter line of the second side wall face 20 passes through the point E2. In other words, the second side wall face 20 does not run off the point E2 outside in the horizontal direction. Accordingly, accumulation of the air is prevented. The undermost point of the second side wall face 20 agrees with the point E3. In other words, the second side wall face 20 inclines downward from the point E2 to the point E3. Accordingly, accumulation of the air is prevented.

The bottom face 22 is convex downward. The bottom face 22 has a curvature radius R3 that is equal to or greater than the phantom curvature radius Rx. In other words, the bottom face 22 curves gently. The air passed through the second side wall face 20 flows along the bottom face 22. The air is smoothly introduced to the opposite second side wall face 20 by means of this bottom face 22. Direction of the air is suddenly changed by the opposite second side wall face 20. This change in direction enhances the dimple effect. In light of smooth air flow, the curvature radius R3 of the bottom face 22 is preferably equal to or more than 1.10 times, and more preferably equal to or more than 1.20 times greater than the phantom curvature radius Rx. The curvature radius R3 of the bottom face 22 is preferably equal to or less than 1.70 times greater than the phantom curvature radius Rx. The curvature radius R3 is preferably equal to or greater than 7.0 mm, and particularly preferably equal to or greater than 8.0 mm. The curvature radius R3 is preferably equal to or less than 35.0 mm.

Maximum diameter line of the bottom face 22 passes through the point E3. In other words, the bottom face 22 does not run off the point E3 outside in the horizontal direction. Accordingly, accumulation of the air is prevented.

Maximum diameter D2 of the second side wall face 20 is preferably 0.60 time or more and 0.95 time or less greater than the diameter D1 of the dimple 8*t*. When the diameter D2 is less than the above range, contributing rate of the second side wall face 20 or the bottom face 22 to the dimple effect may become insufficient. In this respect, the diameter D2 is more preferably equal to or more than 0.70 time, and particularly preferably equal to or more than 0.75 time greater than the diameter D1. When the diameter D2 is beyond the above range, contributing rate of first side wall face 18 to the dimple effect may become insufficient. In this respect, the diameter D2 is more preferably equal to or less than 0.93 time, and particularly preferably equal to or less than 0.90 time greater than the diameter D1.

Maximum diameter D3 of the bottom face 22 is preferably 0.60 time or more and 0.95 time or less greater than the diameter D2. When the diameter D3 is less than the above range, contributing rate of the bottom face 22 to the dimple effect may become insufficient. In this respect, the diameter D3 is more preferably equal to or more than 0.70 time, and particularly preferably equal to or more than 0.75 time greater than the diameter D2. When the diameter D3 is beyond the above range, contributing rate of second side wall face 20 to the dimple effect may become insufficient. In this respect, the diameter D3 is more preferably equal to or less than 0.93 time, and particularly preferably equal to or less than 0.90 time greater than the diameter D2.

What is indicated by a both-oriented arrowhead d1 in FIG. 5 is the depth of the first side wall face 18; what is indicated by a both-oriented arrowhead d2 is the depth of the second side wall face 20; and what is indicated by a both-oriented arrowhead d3 is the depth of the bottom face 22. Sum total of the depth d1, the depth d2 and the depth d3 is the depth d of the dimple 8*t*.

The depth d1 of the first side wall face 18 is preferably 0.10 time or more and 0.50 time or less greater than the depth d of the dimple 8*t*. When the depth d1 is less than the above range, contributing rate of the first side wall face 18 to the dimple effect may become insufficient. In this respect, the depth d1 is more preferably equal to or more than 0.15 time, and particularly preferably equal to or more than 0.20 time greater than the depth d. When the depth d1 is beyond the above range, contributing rate of the second side wall face 20 or the bottom face 22 to the dimple effect may become insufficient. In this respect, the depth d1 is more preferably equal to or less than 0.45 time, and particularly preferably equal to or less than 0.40 time greater than the depth d.

The depth d2 of the second side wall face 20 is preferably 0.10 time or more and 0.60 time or less greater than the depth d of the dimple 8*t*. When the depth d2 is less than the above range, contributing rate of the second side wall face 20 to the dimple effect may become insufficient. In this respect, the depth d2 is more preferably equal to or more than 0.15 time, and particularly preferably equal to or more than 0.20 time greater than the depth d. When the depth d2 is beyond the above range, contributing rate of the first side wall face 18 or the bottom face 22 to the dimple effect may become insufficient. In this respect, the depth d2 is more preferably equal to or less than 0.55 time, and particularly preferably equal to or less than 0.50 time greater than the depth d.

The depth d3 of the bottom face 22 is preferably 0.05 time or more and 0.50 time or less greater than the depth d of the dimple 8*t*. When the depth d3 is less than the above range, contributing rate of the bottom face 22 to the dimple effect may become insufficient. In this respect, the depth d3 is more preferably equal to or more than 0.10 time, and particularly preferably equal to or more than 0.15 time greater than the depth d. When the depth d3 is beyond the above range, contributing rate of the first side wall face 18 or the second side wall face 20 to the dimple effect may become insufficient. In this respect, the depth d3 is more preferably equal to or less than 0.45 time, and particularly preferably equal to or less than 0.40 time greater than the depth d.

Figure 6:
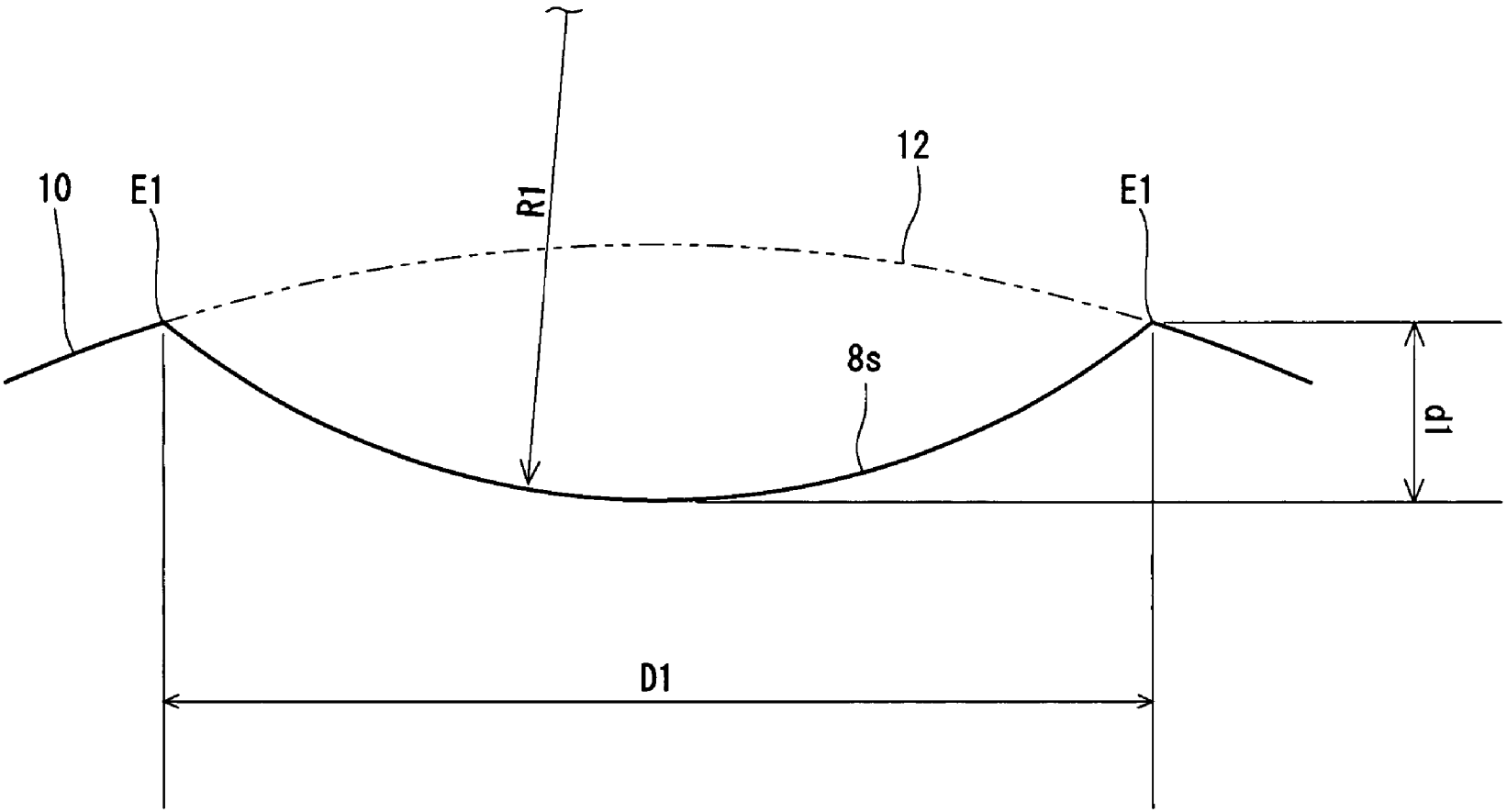
FIG. 6 is an enlarged cross-sectional view illustrating a part of the golf ball shown in FIG. 1.

FIG. 6 is an enlarged cross-sectional view illustrating a part of the golf ball 2 shown in FIG. 1. In this FIG. 6, a single radius dimple 8*s* is illustrated. This single radius dimple 8*s* has a surface having the cross-section that exhibits a circular arc. This single radius dimple 8*s* is continued to the land 10 at an edge E1. The edge E1 may be rounded. In FIG. 6, what is indicated by a both-oriented arrowhead D1 is the diameter; what is indicated by a both-oriented arrowhead d1 is the depth; and what is indicated by an arrowhead R1 is the curvature radius.

Because this golf ball 20 has a soft cover 6 as described above, this golf ball 2 is excellent in the control performance. According to this golf ball 2, presence of the double radius dimples 8*d* and the triple radius dimples 8*t* admixed enables an extremely excellent dimple effect to be exerted. Although the soft cover 6 is disadvantageous in terms of the flight performance, the dimples 8 compensate for the flight performance in this golf ball 2. In light of the flight performance, it is necessary to set the proportion Pd of the number of the double radius dimples 8*d* to the total number of the dimples 8 to be equal to or greater than 20%, and to set the proportion Pt of the number of the triple radius dimples 8*t* to be equal to or greater than 50%. Proportion Ps of the number of the single radius dimples 8*s* to the total number of the dimples 8 may be zero. In light of the flight performance, the proportion Pd is more preferably equal to or greater than 24%, and particularly preferably equal to or greater than 30%. In light of the scuff resistance performance, the proportion Pd is preferably equal to or less than 42%, more preferably equal to or less than 40%, and particularly preferably equal to or less than 38%. In light of the flight performance and scuff resistance performance, the proportion Pt is preferably equal to or greater than 55%. The proportion Pt is equal to or less than 80%.

Area s of the double radius dimple 8*d*, triple radius dimple 8*t* and single radius dimple 8*s* is an area of a region surrounded by the contour line when the center of the golf ball 2 is viewed at infinity. In instances of a circular dimple, the area s is calculated by the following formula:

$$s=(D1/2)^2*\pi.$$

In the golf ball 2 shown in FIG. 2 and FIG. 3, the area of the dimple A' is 20.43 $mm^2$; the area of the dimple B' is 19.63 $mm^2$; the area of the dimple C is 16.62 $mm^2$; the area of the dimple C' is 16.62 $mm^2$; the area of the dimple D is 15.90 $mm^2$; the area of the dimple D' is 15.90 $mm^2$; the area of the dimple E is 13.85 $mm^2$; the area of the dimple F" is 12.57 $mm^2$; and the area of the dimple G is 7.07 $mm^2$.

According to the present invention, ratio of total area of all the dimples 8 to the surface area of the phantom sphere 12 is referred to as an occupation ratio. From the standpoint that a sufficient dimple effect may be achieved, the occupation ratio is preferably equal to or greater than 70%, more preferably equal to or greater than 72%, and particularly preferably equal to or greater than 74%. The occupation ratio is preferably equal to or less than 90%. According to the golf ball 2 shown in FIG. 2 and FIG. 3, total area of the dimples 8 is 4662.2 $mm^2$. Because the surface area of the phantom sphere 12 of this golf ball 2 is 5728.0 $mm^2$, the occupation ratio is 81.4%.

According to the present invention, the term "dimple volume" means a volume of a part surrounded by a plane including the contour of the dimple 8, and the surface of the dimple 8. It is preferred that total volume of the dimples 8 is 250 $mm^3$ or greater and 400 $mm^3$ or less. When the total volume is less than the above range, the golf ball 2 is liable to be hopped. In this respect, the total volume is more preferably equal to or greater than 260 $mm^3$, and particularly preferably equal to or greater than 270 $mm^3$. When the total volume is beyond the above range, the golf ball 2 is liable to be dropped. In this respect, the total volume is more preferably equal to or less than 390 $mm^3$, and particularly preferably equal to or less than 380 $mm^3$.

Depth d of the dimple 8 is preferably 0.07 mm or greater and 0.40 mm or less. When the depth d is less than the above range, the golf ball 2 is liable to be a hopped. In this respect, the depth d is more preferably equal to or greater than 0.10 mm, and particularly preferably equal to or greater than 0.12 mm. When the depth d is beyond than the above range, the golf ball 2 is liable to be dropped. In this respect, the depth d is more preferably equal to or less than 0.35 mm, and particularly preferably equal to or less than 0.30 mm.

It is preferred that total number of the dimples 8 is 200 or greater and 500 or less. When the total number is less than the above range, the dimple effect may be hardly exerted. In this respect, the total number is more preferably equal to or greater than 240, and particularly preferably equal to or greater than 260. When the total number is beyond the above range, the dimple effect may be hardly exerted due to small size of the individual dimples 8. In this respect, the total number is more preferably equal to or less than 480, and particularly preferably equal to or less than 460.

EXAMPLES

Example 1

A rubber composition was obtained by kneading 100 parts by weight of polybutadiene (trade name "BR-730", available from JSR Corporation), 27 parts by weight of zinc acrylate, 5 parts of zinc oxide, an adequate amount of barium sulfate, 0.3 part by weight of bis (pentabromophenyl) disulfide and 0.7 part by weight of dicumyl peroxide. This rubber composition was placed into a mold having upper and lower mold half each having a hemispherical cavity, and heated at 170° C. for 30 minutes to obtain a core having a diameter of 37.1 mm. On the other hand, a type c resin composition shown in Table 2 below was prepared. The aforementioned core was placed into a mold, and the resin composition was injected around the core by injection molding to form a mid layer having a thickness of 1.8 mm. Further, a type f resin composition shown in Table 3 below was prepared. The spherical body comprising the core and the mid layer was placed into a mold having numerous protrusions on the inside face, followed by injection of the aforementioned resin composition around the spherical body by injection molding to form a cover having a thickness of 1.0 mm. Numerous dimples having a shape inverted from the shape of the protrusion were formed on the cover. Paint was applied on this cover to give a golf ball of Example 1 having a diameter of 42.7 mm and a weight of about 45.4 g. This golf ball had a total volume of the dimples of about 320 $mm^3$, and a surface area occupation ratio of about 81%. This golf ball has a dimple pattern of type III shown in Table 5 below. The dimple F" of this golf ball corresponds to tips of the hold pin and bent pin of the mold for the injection molding.

Examples 2 to 4 and Comparative Examples 1 to 5

In a similar manner to Example 1 except that specifications of the core, the mid layer, the cover and the dimples were as listed in Table 6 and Table 7 below, golf balls of Examples 2 to 4 and Comparative Examples 1 to 5 were obtained. Details of the rubber composition of the core are listed in Table 1 below; details of the resin composition of the mid layer are listed in Table 2 below; details of the resin composition of the cover are listed in Table 3 below; and details of specifications of the dimples are listed in Table 4 and Table 5 below.

TABLE 1

Rubber composition of core

| Type | (part by weight) a | b |
|---|---|---|
| Polybutadiene | 100 | 100 |
| Zinc acrylate | 29 | 27 |
| Zinc oxide | 5 | 5 |
| Barium sulfate | adequate amount | adequate amount |
| Bis(pentabromophenyl)disulfide | 0.3 | 0.3 |
| Dicumyl peroxide | 0.7 | 0.7 |

TABLE 2

Resin composition of mid layer

| Type | (part by weight) c | d | e |
|---|---|---|---|
| Surlyn 8945 (material hardness: 61) | 55 | 40 | 40 |
| Surlyn 9945 (material hardness: 60) | 40 | 40 | 30 |
| Rabalon T3339C (material hardness: 7) | 5 | 20 | 30 |
| Hardness (Shore D) | 61 | 55 | 48 |

TABLE 3

Resin composition of cover

| Type | (part by weight) f | g | h |
|---|---|---|---|
| Elastollan XNY97A | 100 | — | — |
| Elastollan XNY85A | — | — | 100 |
| Himilan 1555 | — | 55 | — |
| Himilan 1557 | — | 40 | — |
| Rabalon T3339C | — | 5 | — |
| Titanium dioxide | 3 | 3 | 3 |
| Hardness (Shore D) | 49 | 59 | 35 |

TABLE 4

Specifications of dimples

| | Kind | Number | Closs-sectional shape | D1 (mm) | D2 (mm) | D3 (mm) | d1 (mm) | d2 (mm) | d3 (mm) | d (mm) | F (mm) | R1 (mm) | R2 (mm) | R3 (mm) | Rx (mm) | V ($mm^3$) | D2/D1 | d1/d |
|---|---|---|---|---|---|---|---|---|---|---|---|---|---|---|---|---|---|---|
| Type I | A' | 24 | Double radius | 5.100 | 4.289 | — | 0.060 | 0.051 | — | 0.111 | 0.264 | 1.0 | 45.1 | — | 23.8 | 1.401 | 0.84 | 0.54 |
| | B' | 24 | Double radius | 5.000 | 4.202 | — | 0.061 | 0.050 | — | 0.110 | 0.257 | 1.0 | 44.6 | — | 22.9 | 1.346 | 0.84 | 0.55 |
| | C' | 60 | Double radius | 4.600 | 3.908 | — | 0.061 | 0.042 | — | 0.103 | 0.227 | 1.0 | 45.4 | — | 19.4 | 1.140 | 0.85 | 0.59 |
| | D' | 96 | Double radius | 4.500 | 3.829 | — | 0.061 | 0.041 | — | 0.102 | 0.221 | 1.0 | 44.3 | — | 18.5 | 1.091 | 0.85 | 0.60 |
| | E' | 60 | Double radius | 4.200 | 3.571 | — | 0.061 | 0.040 | — | 0.101 | 0.205 | 1.0 | 40.0 | — | 16.2 | 0.950 | 0.85 | 0.60 |
| | F" | 14 | Single radius | 4.000 | — | — | 0.137 | — | — | 0.137 | 0.231 | 14.7 | — | — | — | 0.862 | — | 1.00 |
| | G' | 24 | Double radius | 3.000 | 2.433 | — | 0.065 | 0.037 | — | 0.102 | 0.155 | 1.0 | 20.0 | — | 8.3 | 0.486 | 0.81 | 0.64 |
| Type II | A | 24 | Triple radius | 5.100 | 4.293 | 3.521 | 0.040 | 0.036 | 0.056 | 0.132 | 0.285 | 23.8 | 3.0 | 27.5 | 23.8 | 1.401 | 0.84 | 0.24 |
| | B | 24 | Triple radius | 5.000 | 4.209 | 3.519 | 0.040 | 0.036 | 0.054 | 0.130 | 0.277 | 22.9 | 3.0 | 28.5 | 22.9 | 1.346 | 0.84 | 0.24 |
| | C | 60 | Triple radius | 4.600 | 3.873 | 3.095 | 0.040 | 0.039 | 0.053 | 0.132 | 0.256 | 19.4 | 3.0 | 22.5 | 19.4 | 1.140 | 0.84 | 0.23 |
| | D | 96 | Triple radius | 4.500 | 3.789 | 3.036 | 0.040 | 0.039 | 0.052 | 0.131 | 0.250 | 18.5 | 3.0 | 22.3 | 18.5 | 1.091 | 0.84 | 0.24 |
| | E | 60 | Triple radius | 4.200 | 3.536 | 2.836 | 0.040 | 0.040 | 0.048 | 0.128 | 0.232 | 16.2 | 3.0 | 21.0 | 16.2 | 0.950 | 0.84 | 0.24 |

TABLE 4-continued

| | Kind | Number | Closs-sectional shape | D1 (mm) | D2 (mm) | D3 (mm) | d1 (mm) | d2 (mm) | d3 (mm) | d (mm) | F (mm) | R1 (mm) | R2 (mm) | R3 (mm) | Rx (mm) | V ($mm^3$) | D2/D1 | d1/d |
|---|---|---|---|---|---|---|---|---|---|---|---|---|---|---|---|---|---|---|
| | | | | Specifications of dimples | | | | | | | | | | | | | | |
| | F" | 14 | Single radius | 4.000 | — | — | 0.137 | — | — | 0.137 | 0.231 | 14.7 | — | — | — | 0.862 | — | 1.00 |
| | G | 24 | Triple radius | 3.000 | 2.527 | 1.999 | 0.040 | 0.042 | 0.036 | 0.118 | 0.171 | 8.3 | 3.0 | 14.0 | 8.3 | 0.486 | 0.84 | 0.25 |

TABLE 5

| | Kind | Number | Closs-sectional shape | D1 (mm) | D2 (mm) | D3 (mm) | d1 (mm) | d2 (mm) | d3 (mm) | d (mm) | F (mm) | R1 (mm) | R2 (mm) | R3 (mm) | Rx (mm) | V ($mm^3$) | D2/D1 | d1/d |
|---|---|---|---|---|---|---|---|---|---|---|---|---|---|---|---|---|---|---|
| | | | | Specifications of dimples | | | | | | | | | | | | | | |
| Type III | A' | 24 | Double radius | 5.100 | 4.289 | — | 0.060 | 0.051 | — | 0.111 | 0.264 | 1.0 | 45.1 | — | 23.8 | 1.401 | 0.84 | 0.54 |
| | B' | 24 | Double radius | 5.000 | 4.202 | — | 0.061 | 0.050 | — | 0.110 | 0.257 | 1.0 | 44.6 | — | 22.9 | 1.346 | 0.84 | 0.55 |
| | C | 36 | Triple radius | 4.600 | 3.873 | 3.095 | 0.040 | 0.039 | 0.053 | 0.132 | 0.256 | 19.4 | 3.0 | 22.5 | 19.4 | 1.140 | 0.84 | 0.23 |
| | C' | 24 | Double radius | 4.600 | 3.908 | — | 0.061 | 0.042 | — | 0.103 | 0.227 | 1.0 | 45.4 | — | 19.4 | 1.140 | 0.85 | 0.59 |
| | D | 72 | Triple radius | 4.500 | 3.789 | 3.036 | 0.040 | 0.039 | 0.052 | 0.131 | 0.250 | 18.5 | 3.0 | 22.3 | 18.5 | 1.091 | 0.84 | 0.24 |
| | D' | 24 | Double radius | 4.500 | 3.829 | — | 0.061 | 0.041 | — | 0.102 | 0.221 | 1.0 | 44.3 | — | 18.5 | 1.091 | 0.85 | 0.60 |
| | E | 60 | Triple radius | 4.200 | 3.536 | 2.836 | 0.040 | 0.040 | 0.048 | 0.128 | 0.232 | 16.2 | 3.0 | 21.0 | 16.2 | 0.950 | 0.84 | 0.24 |
| | F" | 14 | Single radius | 4.000 | — | — | 0.137 | — | — | 0.137 | 0.231 | 14.7 | — | — | — | 0.862 | — | 1.00 |
| | G | 24 | Triple radius | 3.000 | 2.527 | 1.999 | 0.040 | 0.042 | 0.036 | 0.118 | 0.171 | 8.3 | 3.0 | 14.0 | 8.3 | 0.486 | 0.84 | 0.25 |
| Type IV | A | 24 | Triple radius | 5.100 | 4.293 | 3.521 | 0.040 | 0.036 | 0.056 | 0.132 | 0.285 | 23.8 | 3.0 | 27.5 | 23.8 | 1.401 | 0.84 | 0.24 |
| | B | 24 | Triple radius | 5.000 | 4.209 | 3.519 | 0.040 | 0.036 | 0.054 | 0.130 | 0.277 | 22.9 | 3.0 | 28.5 | 22.9 | 1.346 | 0.84 | 0.24 |
| | C' | 60 | Double radius | 4.600 | 3.908 | — | 0.061 | 0.042 | — | 0.103 | 0.227 | 1.0 | 45.4 | — | 19.4 | 1.140 | 0.85 | 0.59 |
| | D | 36 | Triple radius | 4.500 | 3.789 | 3.036 | 0.040 | 0.039 | 0.052 | 0.131 | 0.250 | 18.5 | 3.0 | 22.3 | 18.5 | 1.091 | 0.84 | 0.24 |
| | D' | 60 | Double radius | 4.500 | 3.829 | — | 0.061 | 0.041 | — | 0.102 | 0.221 | 1.0 | 44.3 | — | 18.5 | 1.091 | 0.85 | 0.60 |
| | E | 60 | Triple radius | 4.200 | 3.536 | 2.836 | 0.040 | 0.040 | 0.048 | 0.128 | 0.232 | 16.2 | 3.0 | 21.0 | 16.2 | 0.950 | 0.84 | 0.24 |
| | F" | 14 | Single radius | 4.000 | — | — | 0.137 | — | — | 0.137 | 0.231 | 14.7 | — | — | — | 0.862 | — | 1.00 |
| | G | 24 | Triple radius | 3.000 | 2.527 | 1.999 | 0.040 | 0.042 | 0.036 | 0.118 | 0.171 | 8.3 | 3.0 | 14.0 | 8.3 | 0.486 | 0.84 | 0.25 |

[Measurement of Resilience Coefficient]

To the golf ball was impacted a hollow cylinder made of aluminum the weight of which being 200 g at a velocity of 45 m/s. Then, velocity of the hollow cylinder prior to and after the impact, and the velocity of the golf ball after the impact were measured to determine the resilience coefficient of the golf ball. Mean values obtained by 12 times measurement are shown in Table 6 and Table 7 below as indices on the basis of the resilience coefficient of the golf ball of Comparative Example 1 being presumed as 1.00.

[Travel Distance Test]

A driver with a metal head (trade name "XXIO", available from Sumitomo Rubber Industries, Ltd., shaft hardness: S, loft angle: 10°) was attached to a swing machine, available from Golf Laboratory Co. Then the golf ball was hit under a condition to provide a head speed of 45 m/sec. Accordingly, the distance from the launching point to the point where the ball stopped was measured. Mean values of 12 times measurement are shown in Table 6 and Table 7 below.

[Evaluation of Scuff Resistance Performance]

A sand wedge (trade name "XXIO", available from Sumitomo Rubber Industries, Ltd., shaft hardness: S, loft angle: 56°) was attached the swing machine described above. Then the golf ball was hit under the condition to provide a head speed of 21 m/sec. Accordingly, appearance of the golf ball was visually observed. Twenty golf balls were observed, and then rated into four ranks of from "A" to "D". The results are presented in Table 6 and Table 7 below. The rank "A" is most preferred.

[Evaluation of Control Performance]

Using a pitching wedge, the golf balls were hit by 10 golf players, and their control performance was evaluated as to whether they are favorable or not. The results are presented in Table 6 and Table 7 below.

TABLE 6

Figure 7:
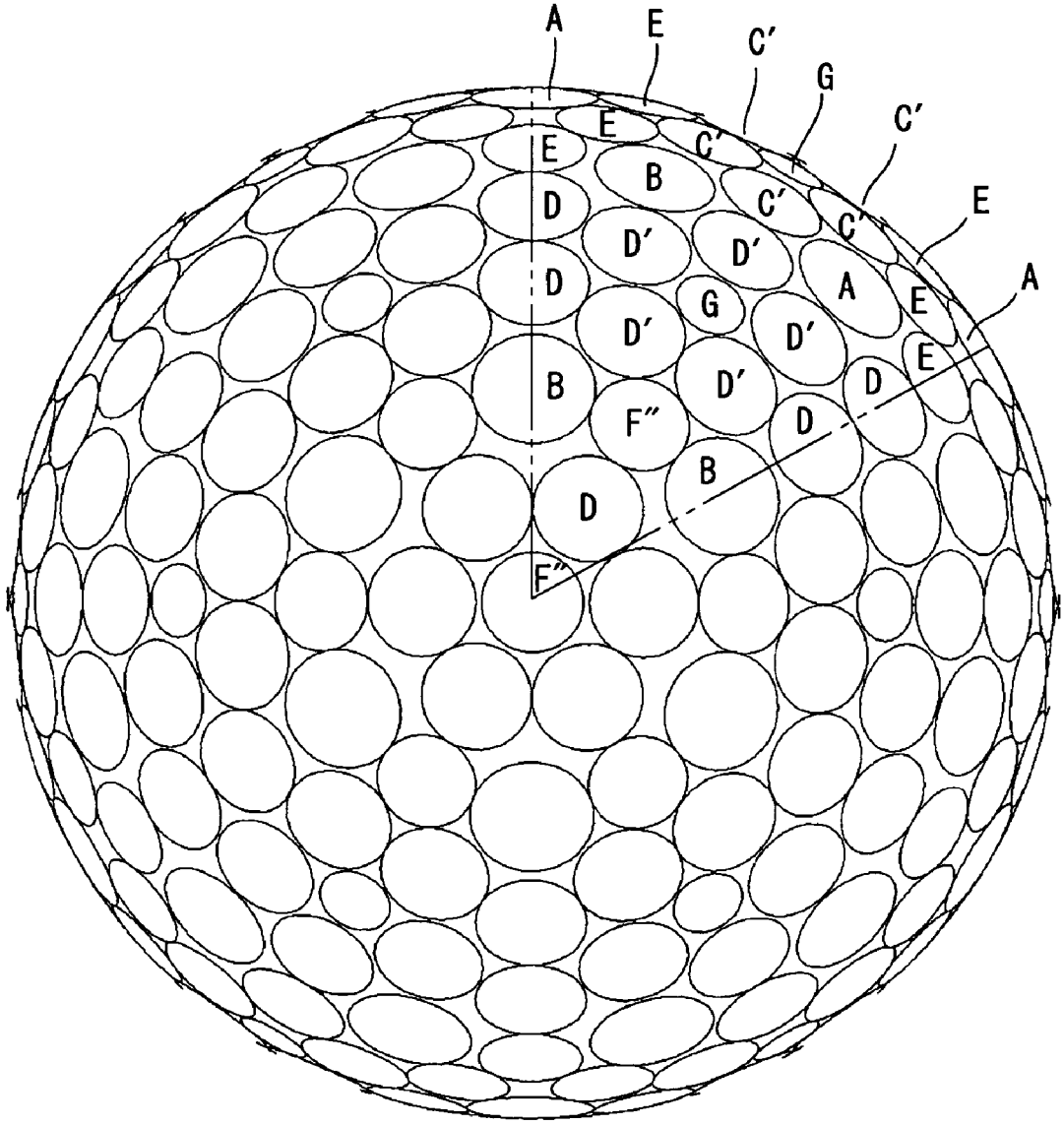
FIG. 7 a plan view illustrating a golf ball according to Example 4 of the present invention.
Figure 8:
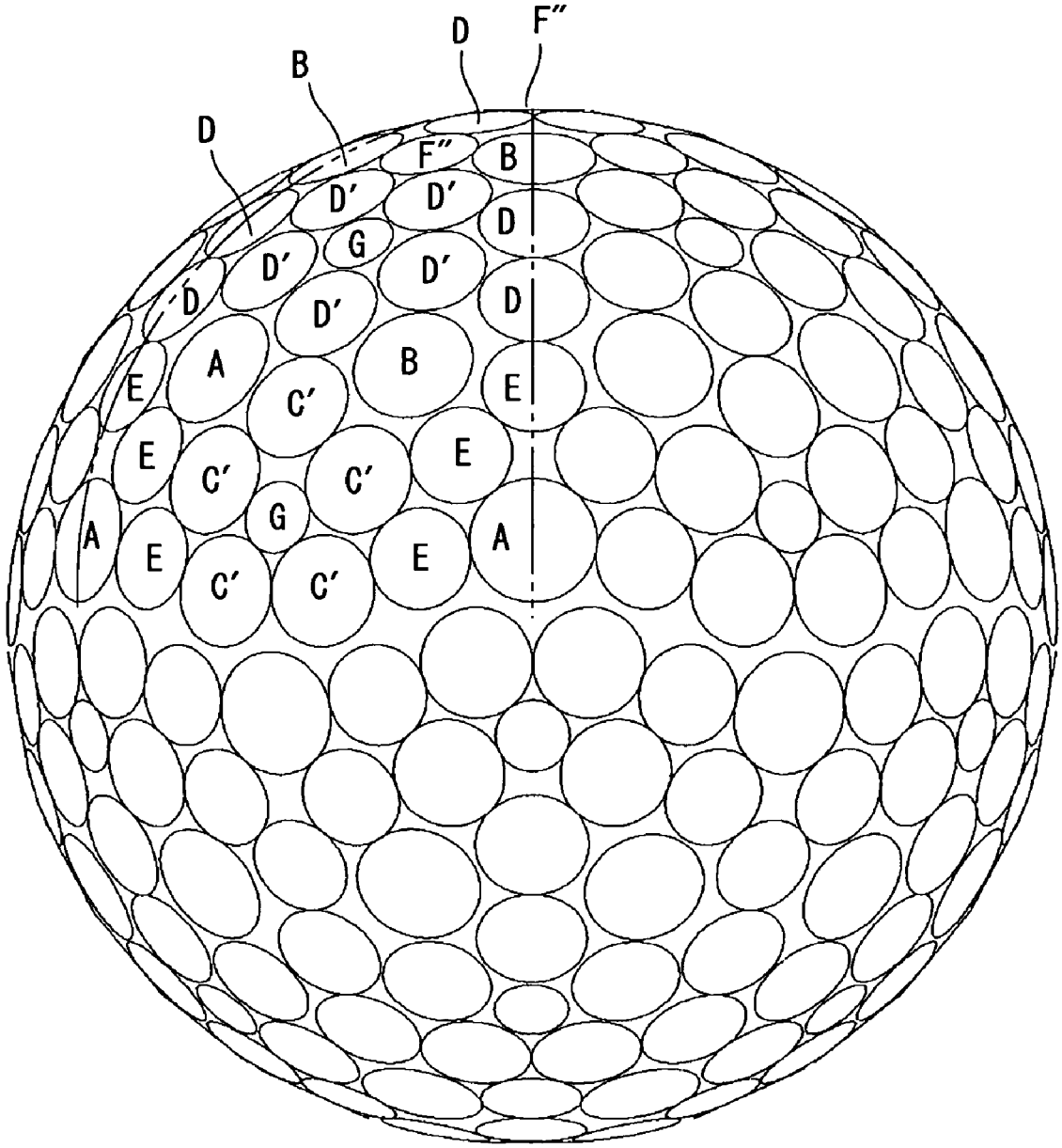
FIG. 8 is a front view illustrating the golf ball shown in FIG. 7.

| | | Example 1 | Example 2 | Example 3 | Example 4 |
|---|---|---|---|---|---|
| | | Results of evaluation | | | |
| Core | Type | b | a | a | b |
| | Diameter (mm) | 37.1 | 31.9 | 37.9 | 37.9 |
| | Amount of compressive deformation (mm) | 3.4 | 3.0 | 3.0 | 3.4 |
| Mid layer | Type | c | d | c | c |
| | Hardness Hm (Shore D) | 61 | 55 | 61 | 61 |
| | Thickness Tm (mm) | 1.8 | 1.6 | 1.8 | 1.8 |
| Cover | Type | f | f | f | h |
| | Hardness Hc (Shore D) | 49 | 49 | 49 | 35 |
| | Thickness Tc (mm) | 1.0 | 0.8 | 0.6 | 0.6 |
| Dimple | Type | III | III | III | IV |
| | Plan view | FIG. 2 | FIG. 2 | FIG. 2 | FIG. 7 |
| | Front view | FIG. 3 | FIG. 3 | FIG. 3 | FIG. 8 |
| | Proportion Pd (%) | 31.8 | 31.8 | 31.8 | 39.8 |
| | Proportion Pt (%) | 63.6 | 63.6 | 63.6 | 55.6 |
| | Proportion Ps (%) | 4.6 | 4.6 | 4.6 | 4.6 |
| Tm/Tc | | 1.80 | 2.00 | 3.00 | 3.00 |
| Resilience coefficient (index) | | 1.01 | 1.01 | 1.03 | 1.01 |

TABLE 6-continued

| | Results of evaluation | | | |
|---|---|---|---|---|
| | Example 1 | Example 2 | Example 3 | Example 4 |
| Travel distance (m) | 222.5 | 223.0 | 225.0 | 222.0 |
| Scuff resistance performance | A | A | A | B |
| Control performance | Favorable | Favorable | Favorable | Favorable |

TABLE 7

Figure 9:
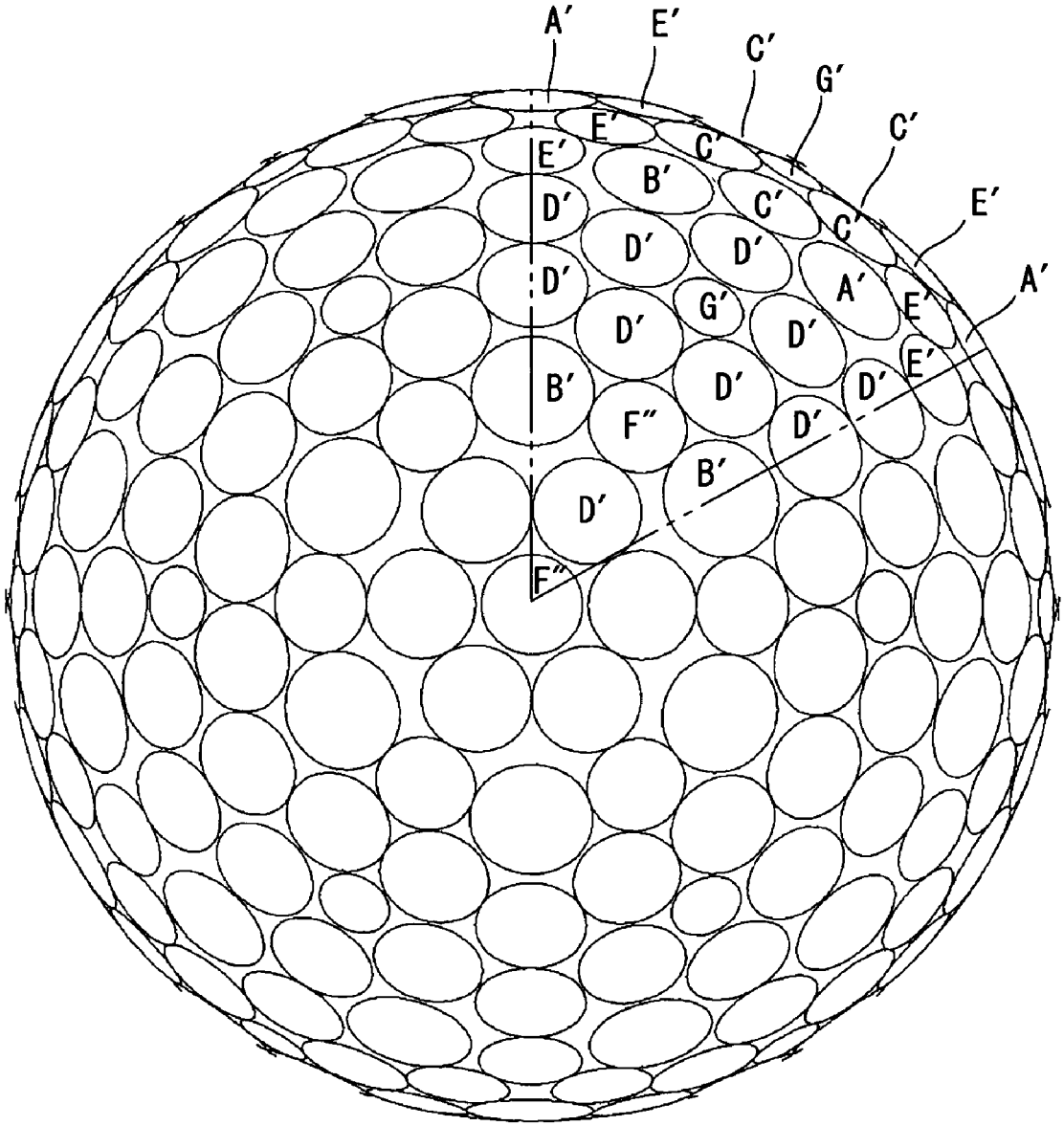
FIG. 9 is a plan view illustrating a golf ball according to Comparative Example 2.
Figure 10:
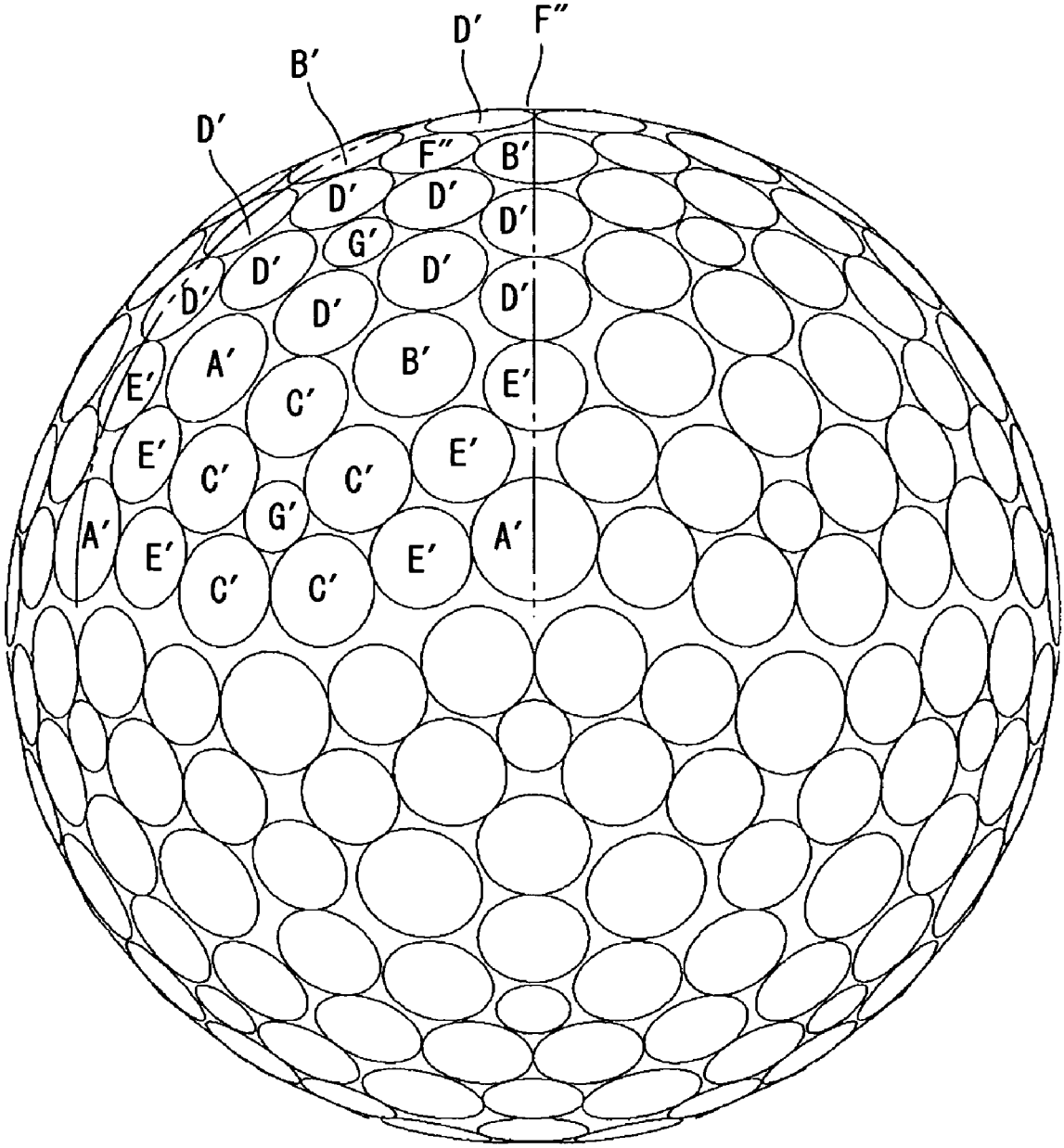
FIG. 10 is a front view illustrating the golf ball shown in FIG. 9.
Figure 11:
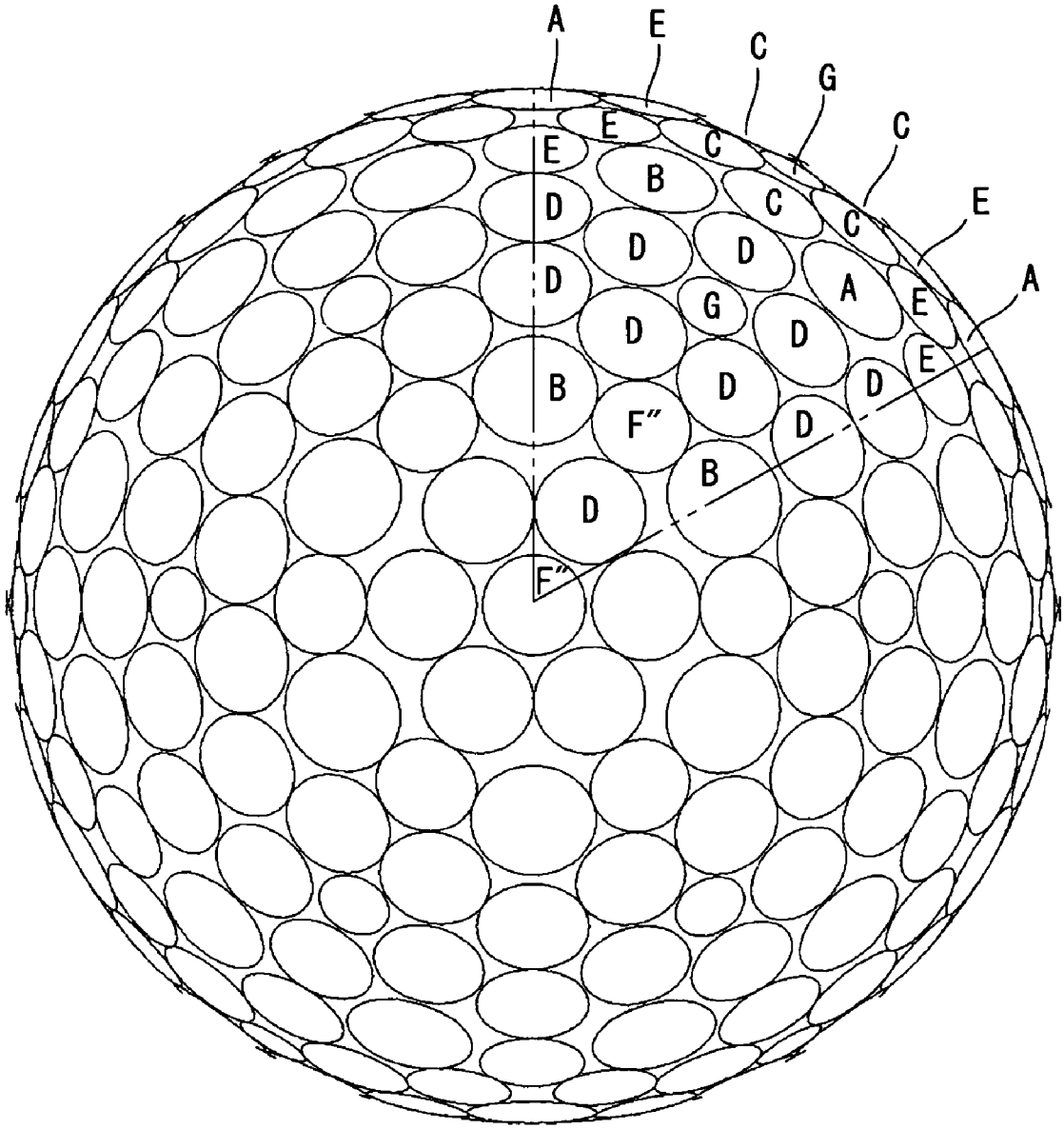
FIG. 11 a plan view illustrating a golf ball according to Comparative Example 3.
Figure 12:
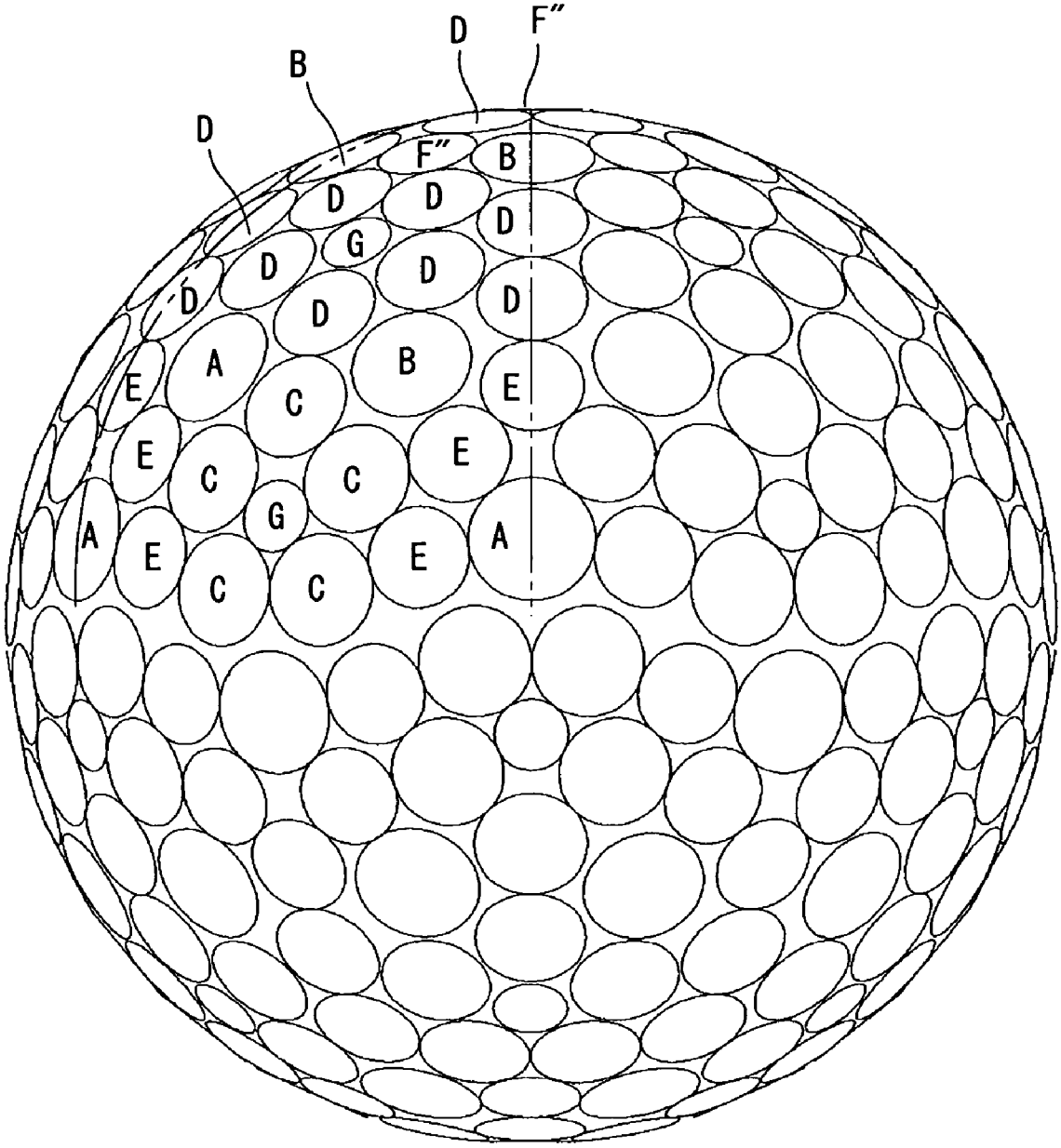
FIG. 12 is a front view illustrating the golf ball shown in FIG. 11.

| | | Results of evaluation | | | | |
|---|---|---|---|---|---|---|
| | | Compa. Example 1 | Compa. Example 2 | Compa. Example 3 | Compa. Example 4 | Compa. Example 5 |
| Core | Type | b | b | b | a | b |
| | Diameter (mm) | 35.9 | 37.5 | 37.9 | 37.5 | 37.5 |
| | Amount of compressive deformation (mm) | 3.4 | 3.4 | 3.4 | 3.0 | 3.4 |
| Mid layer | Type | c | c | c | e | d |
| | Hardness Hm (Shore D) | 61 | 61 | 61 | 48 | 55 |
| | Thickness Tm (mm) | 1.8 | 1.6 | 1.8 | 1.6 | 1.6 |
| Cover | Type | f | f | h | f | g |
| | Hardness Hc (Shore D) | 49 | 49 | 35 | 49 | 59 |
| | Thickness Tc (mm) | 1.6 | 1.0 | 0.6 | 1.0 | 1.0 |
| Dimple | Type | III | I | II | III | III |
| | Plan view | FIG. 2 | FIG. 9 | FIG. 11 | FIG. 2 | FIG. 2 |
| | Front view | FIG. 3 | FIG. 10 | FIG. 12 | FIG. 3 | FIG. 3 |
| | Proportion Pd (%) | 31.8 | 95.4 | 0 | 31.8 | 31.8 |
| | Proportion Pt (%) | 63.6 | 0 | 95.4 | 63.6 | 63.6 |
| | Proportion Ps (%) | 4.6 | 4.6 | 4.6 | 4.6 | 4.6 |
| Tm/Tc | | 1.13 | 1.60 | 3.00 | 1.60 | 1.60 |
| Resilience coefficient (index) | | 1.00 | 1.01 | 1.01 | 0.98 | 1.02 |
| Travel distance (in) | | 220.0 | 223.0 | 220.5 | 220.0 | 223.0 |
| Scuff resistance | | A | D | A | A | A |
| Control performance | | Favorable | Favorable | Favorable | Favorable | Un-favorable |

As shown in Table 6 and Table 7, the golf balls of Examples are excellent in the flight performance, scuff resistance performance and control performance. Therefore, advantages of the present invention are clearly suggested by these results of evaluation.

The present invention is applicable to golf balls which may be used in playing on a golf course, as well as golf balls which may be used on a driving range.

The foregoing description is just for illustrative examples, therefore, various modifications can be made in the scope without departing from the principles of the present invention.

What is claimed is:

1. A golf ball comprising a core, a mid layer and a cover, said mid layer having a hardness of 50 or greater and 70 or less, and a thickness of equal to or greater than 0.8 mm, said cover having a hardness of less than 57, and a thickness of less than 1.5 mm, said golf ball having numerous double radius dimples and numerous triple radius dimples on the surface thereof, said double radius dimple comprising a first side wall face having a curvature radius R1, and a bottom face having a curvature radius R2 that is 5 times or more and 55 times or less greater than the curvature radius R1 and being positioned to the bottom side than the first side wall face, said triple radius dimple comprising a first side wall face having a curvature radius R1 that is equal to or greater than a phantom curvature radius Rx, a second side wall face being positioned to the bottom side than the first side wall face and having a curvature radius R2 that is smaller than the phantom curvature radius Rx, and a bottom face being positioned to the bottom side than the second side wall face and having a curvature radius R3 that is equal to or greater than the phantom curvature radius Rx, proportion of the number of the double radius dimples in total number of the dimples being 20% or greater and 42% or less, and proportion of the number of the triple radius dimples in total number of the dimples being equal to or greater than 50%.

2. The golf ball according to claim 1 wherein the depth of the first side wall face is 0.20 time or more and 0.70 time or less greater than the depth of the dimple in said double radius dimple.

3. The golf ball according to claim 1 wherein the maximum diameter of the bottom face is 0.60 time or more and 0.95 time or less greater than the diameter of the dimple in said double radius dimple.

4. The golf ball according to claim 1 wherein the depth of the first side wall face is 0.10 time or more and 0.50 time or less greater than the depth of the dimple in said triple radius dimple.

5. The golf ball according to claim 1 wherein the maximum diameter of the second side wall face is 0.60 time or more and 0.95 time or less greater than the diameter of the dimple in said triple radius dimple.

6. The golf ball according to claim 1 wherein the first side wall face and the bottom face of said double radius dimple, and the first side wall face, the second side wall face and the bottom face of said triple radius dimple are convex downward.

7. The golf ball according to claim 1 wherein ratio (Tm/Tc) of the thickness Tm of the mid layer to the thickness Tc of the cover is 0.5 or greater and 4.0 or less.

* * * * *